US007318730B2

(12) United States Patent
Miyazaki

(10) Patent No.: US 7,318,730 B2
(45) Date of Patent: Jan. 15, 2008

(54) FINE-PITCH ANTI-WICKING TERMINALS AND CONNECTORS USING SAME

(75) Inventor: Tatsuya Miyazaki, Tokyo (JP)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/362,698

(22) Filed: Feb. 27, 2006

(65) Prior Publication Data

US 2006/0194458 A1 Aug. 31, 2006

(30) Foreign Application Priority Data

Feb. 28, 2005 (JP) ..... 2005-054895

(51) Int. Cl.
*H01R 12/00* (2006.01)

(52) U.S. Cl. ..... 439/83

(58) Field of Classification Search ..... 439/83, 439/874, 81, 492, 578; 174/52; 361/400–406
See application file for complete search history.

(56) References Cited

U.S. PATENT DOCUMENTS 3,780,433 A * 12/1973 Lynch ..... 29/843
4,992,056 A * 2/1991 Douty et al. ..... 439/83
5,934,951 A 8/1999 Lai et al.
6,095,872 A * 8/2000 Lang et al. ..... 439/733.1
6,239,375 B1 5/2001 Shinchi
6,261,136 B1 * 7/2001 Dennis ..... 439/876
6,571,469 B2 * 6/2003 Okada et al. ..... 29/852
6,780,028 B1 * 8/2004 Kennedy et al. ..... 439/83
6,787,700 B2 * 9/2004 Nagao et al. ..... 174/541

FOREIGN PATENT DOCUMENTS

EP 0 881 708 12/1998
EP 1 049 218 11/2000
WO WO 98/49760 11/1998

OTHER PUBLICATIONS

International Search Report of International Appl No. PCT/US2006/007054, Jun. 22, 2006.

* cited by examiner

*Primary Examiner*—Chandrika Prasad
(74) *Attorney, Agent, or Firm*—Thomas D. Paulius

(57) ABSTRACT

A fine-pitch terminal and connector reduces the size of a connector in a direction in which a large number of terminals are arranged in parallel. A terminal is applied to a connector, to which a cable having a conductor covered with an insulator is attached, the terminal being connected to the conductor of the cable by soldering. The terminal has a soldering region which is provided in a part of the terminal and to which the conductor of the cable is soldered, and the soldering region has a depression for receiving a fillet.

17 Claims, 36 Drawing Sheets

(b) PRIOR ART

FINE-PITCH ANTI-WICKING TERMINALS AND CONNECTORS USING SAME

BACKGROUND OF THE INVENTION

The present invention relates to a terminal and a connector using the terminal. The terminal is for fine-pitch uses and has an anti-wicking feature to control the flow of molten solder during assembly.

Coaxial cables are known as cables for transmitting high-frequency signals in portable telephones, personal computers, and the like in order to transmit a large volume of information. As shown in FIGS. 37 and 38, a typical coaxial cable 300 is composed of a signal line 306 having a centrally located inner conductor 302 covered with an inner insulator 304, an outer conductor 308 consisting of a large number of spirally wound or braided electric wires and covering the signal line 306, and an outer insulator 310 covering the outer conductor 308.

A soldering method, a pressure welding method, and other connection methods are employed in the prior art for connecting the coaxial cable 300 to a connector. When soldering is employed for effecting this connection, as shown in FIG. 39 according to the prior art, it is necessary to expose the outer conductor 308 and the inner conductor 302 by stripping off the outer insulator 310 and the inner insulator 304, twist the outer conductor 308 into a strand, and then solder the inner conductor 302 and the outer conductor 308 onto their associated terminals 312 of the connector. A portion formed by the solidification of the molten solder H (fused solder) is referred to in the art and herein as a fillet Fh.

As the types of connectors have diversified in recent years, connectors having a large number of terminals have become known. These include connectors in which the large number of terminals are arranged in parallel, with flat cables consisting of a large number of coaxial cables being connected to those terminals. When soldering a large number of coaxial cables to terminals, space constraints are encountered. In addition, the fillet must have a certain size to secure the cables with the requisite soldering strength. As described above, a fillet is a build-up of solidified fused solder. Thus, upon soldering, the fused solder flows on the terminal surface to some extent. Accordingly, a typical fillet-forming portion of the terminal is dimensioned with some margin of allowance by taking into account this flow of the fused solder on the terminal surface. Further, in a typical assembly a suitable gap must be secured between adjacent terminals to ensure that even when the fused solder flows toward an adjacent terminal, the fused solder does not reach the adjacent terminal.

However, even when a gap is secured between adjacent terminals, the gap between the terminals must be small when the terminal itself is small. These can be considered to be "fine-pitch" or narrow-pitch arrangements, and they increase the likelihood that the flow of fused solder may reach between adjacent terminals. Further, when the fused solder flows to reach even a portion of the terminal which comes into contact with the terminal of an associated mating connector paired with the connector, contact resistance increases due to the fused solder thus intervening between the two connectors, and this may become a factor for poor contact reliability between the connector and the mating connector.

One method for avoiding this problem is to fill up gaps by over-molding between the portion where soldering is performed on the terminal of a connector and the portion where respective terminals of the connector and its mating connector are connected to one another upon connecting the two terminals. However, such a manufacturing process using over-molding is extremely difficult in cases involving a narrow pitch of 0.3 mm or less. Meanwhile, the need for miniaturization has been increasing over the years, which means that the outer dimensions of connectors cannot be increased. Hence, the above problem must be overcome solely through improvements in connection components.

Prior publications exemplify teaching technologies for effecting solder connection between a connector and a coaxial cable or other such electric wire. These include Japanese Patent Publications No. JP 11-260439 A, No. JP 2002-324592 A and No. JP 06-45035 A. Also, U.S. Pat. No. 5,934,951 relates to anti-wicking conductive contrast for an electrical connector. This shows angled grooves for carrying solder during wave soldering.

SUMMARY OF THE INVENTION

Problems such as these are addressed with advantageous results by the present invention. In this regard, it is an object of the present invention to provide a technology by which a connector having coaxial cables and a large number of terminals arranged at a narrow-pitch are solder-connected together. By this technology, the strength of a fillet formed during the soldering connection between the terminals and the coaxial cables can be secured while preventing the fused solder from flowing out from a soldering region where soldering is to be performed on the terminals, whereby, in the narrow-pitch connector, proper soldering is effected between the terminals and the cables, and further, even when the amount of fused solder is so large as to cause the fused solder to flow to the portion of the terminals which comes into contact with the mating terminals, it is possible to effectively suppress such flow of fused solder.

To attain the above object, the present invention provides a terminal which is applied to a connector, to which a cable having a conductor covered with an insulator is attached, the terminal being connected to the conductor of the cable by soldering, characterized in that the terminal has a soldering region which is provided in a part of the terminal and to which the conductor of the cable is soldered, the soldering region having a depression for receiving a fillet.

The terminal of the present invention is provided with such a depression, whereby the fused solder is received within the depression without spreading, forming the fillet. Accordingly, there is relatively little spreading of the fillet over the terminal surface as compared with the conventional terminals having no such depression in the soldering region. Due to the formation of the fillet within the depression, the volume of the fillet formed between the terminal and the cable increases. Further, when the soldering region of the terminal is formed to be larger in the width direction thereof than the other area of the terminal, thereby defining a stepped portion having a step formed at a boundary portion between the stepped portion and the other area, the fused solder spreads toward and around the periphery of the stepped portion, whereby the fused solder is prevented from unnecessarily spreading to the other area as compared with the case where no such stepped portion is formed.

In an important aspect of the invention, the strength of the connection force with which the conductor is connected to the terminal through the fillet can be maintained even when the fillet is reduced in width dimension. Therefore the spacing between the terminals can be reduced while maintaining the connection force between the terminal and the cable as it is. As a result, in a fine-pitch connector having a large number of terminals arranged in parallel, the dimension of the connector can be reduced in the direction in which the terminals are arranged in parallel. Further, even when the amount of fused solder is large, it is possible to effectively suppress the flow of fused solder to the portion of the terminal which comes into contact with the mating terminal.

Other aspects, objects and advantages of the present invention will be understood from the following description according to the preferred embodiments of the present invention, specifically including stated and unstated combinations of the various features which are described herein, relevant information concerning which is shown in the accompanying drawings.

DESCRIPTION OF THE PREFERRED EMBODIMENTS

As required, detailed embodiments of the present invention are disclosed herein; however, it is to be understood that the disclosed embodiments are merely exemplary of the invention, which may be embodied in various forms. Therefore, specific details disclosed herein are not to be interpreted as limiting, but merely as a basis for the claims and as a representative basis for teaching one skilled in the art to variously employ the present invention in virtually any appropriate manner.

Figure 1:
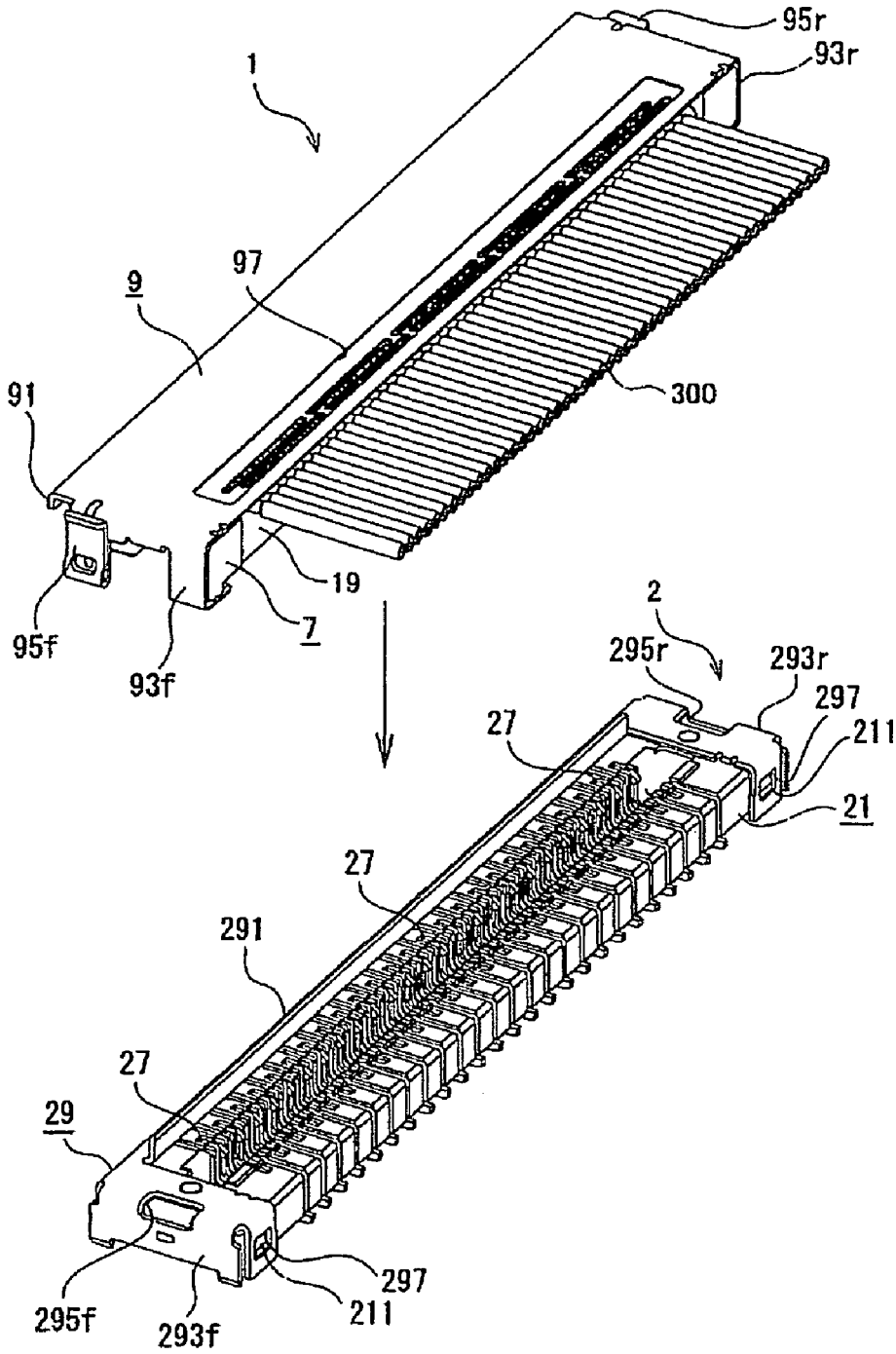
FIG. 1 is a perspective view showing, together with a mating connector, a connector according to the present invention in a state prior to its mounting to the mating connector.
Figure 2:
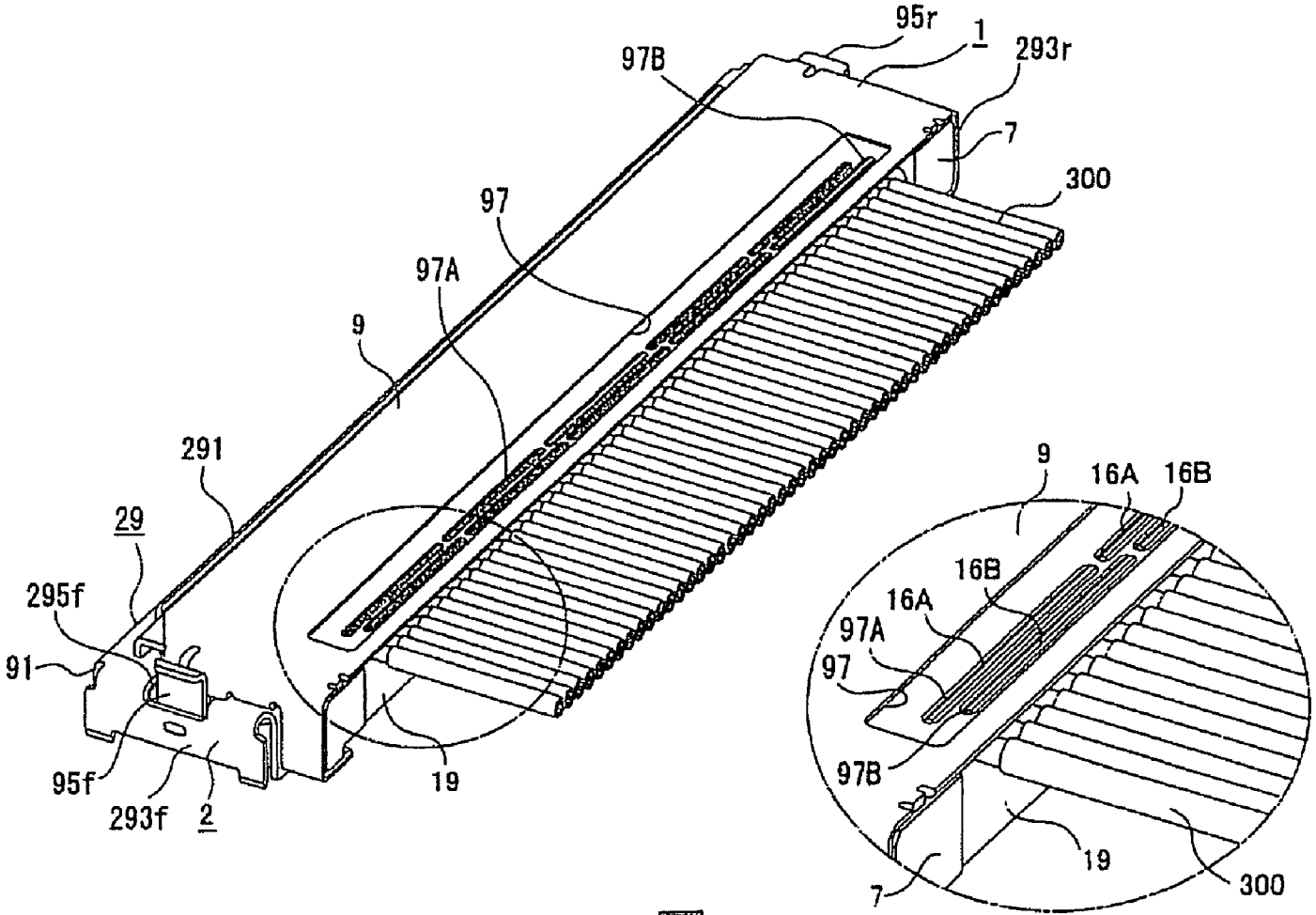
FIG. 2 is a perspective view showing the connector of the present invention as mounted to the mating connector, and an enlarged view of a selected portion thereof.
Figure 3:
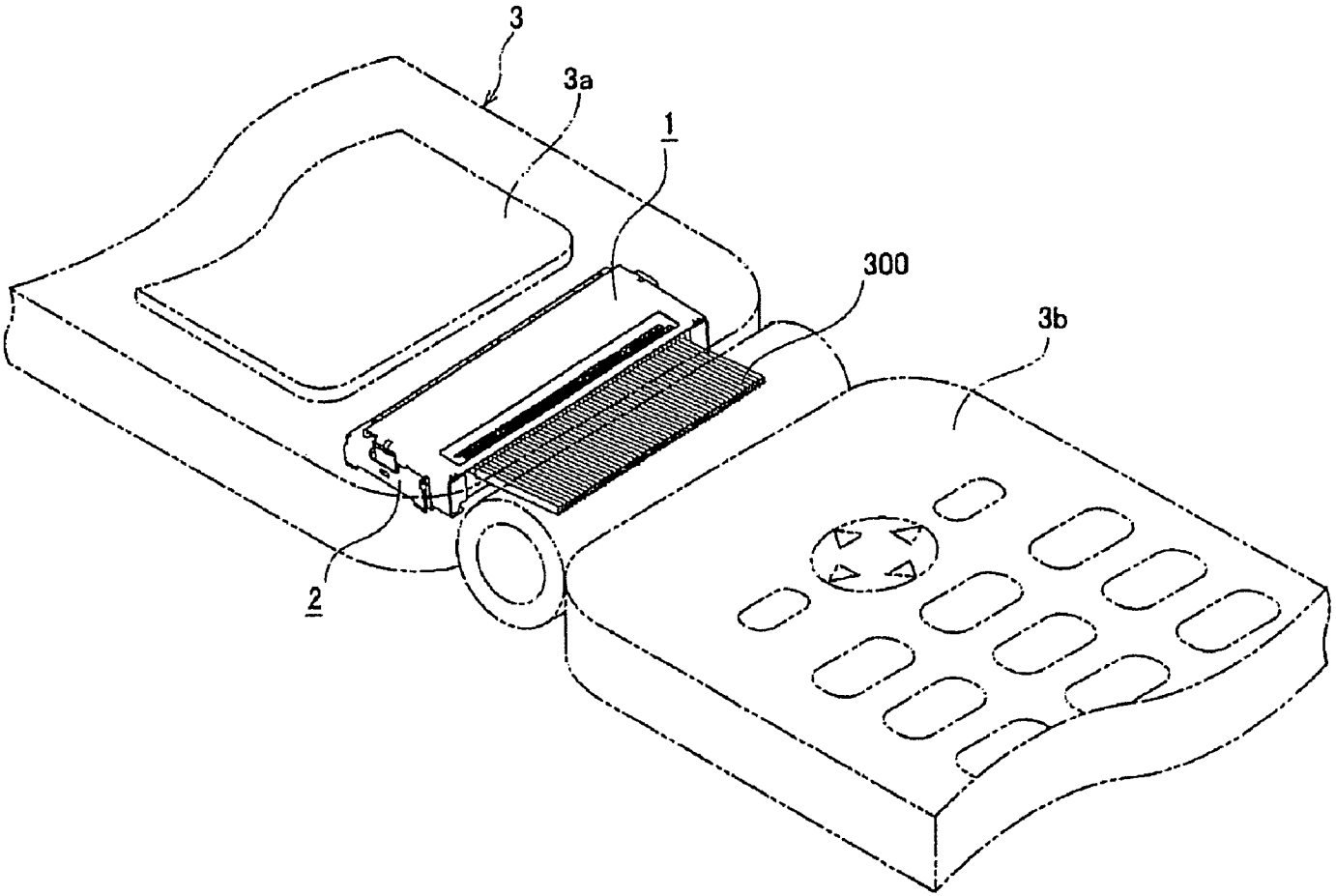
FIG. 3 is a perspective view showing the connector according to the present invention as applied to a foldable portable telephone.

FIG. 1 is a perspective view illustrating, together with a mating connector 2, a connector 1 according to the present invention in a state prior to its mounting to the mating connector 2. Further, FIG. 2 is a perspective view of the connector 1 as mated with the mating connector 2. It is to be noted that, although not shown in FIG. 2, the connector 1 is also attached to the other end portion of a coaxial cable 300 for mounting to the mating connector 2. FIG. 3 illustrates an example where the connectors 1, 2 are applied to a foldable portable telephone 3 indicated by imaginary lines.

Connector 1 provided at one end of the coaxial cable 300 is connected to the mating connector 2 provided in a substrate (not shown) on a liquid crystal screen side 3*a* of the portable telephone 3, and another connector 1 (not shown) is provided at the other end of the coaxial cable 300 and is connected to another mating connector 2 provided in a substrate on an operation button side 3*b* of the portable telephone 3. Accordingly, signals are transmitted between the liquid crystal screen side 3*a* and the operation button side 3*b* of the portable telephone 3, through the coaxial cable 300 having the connector 1 and the mating connector 2 provided at its opposite ends, from the operation button side 3*b* toward the liquid crystal screen side 3*a*.

As can been seen from FIG. 1 and FIGS. 4 through 7, the connector 1 has a housing 7 serving as the base of the connector 1, and a shell 9 fitted on the housing 7 to cover terminals and other parts contained in the housing 7.

Figure 4:
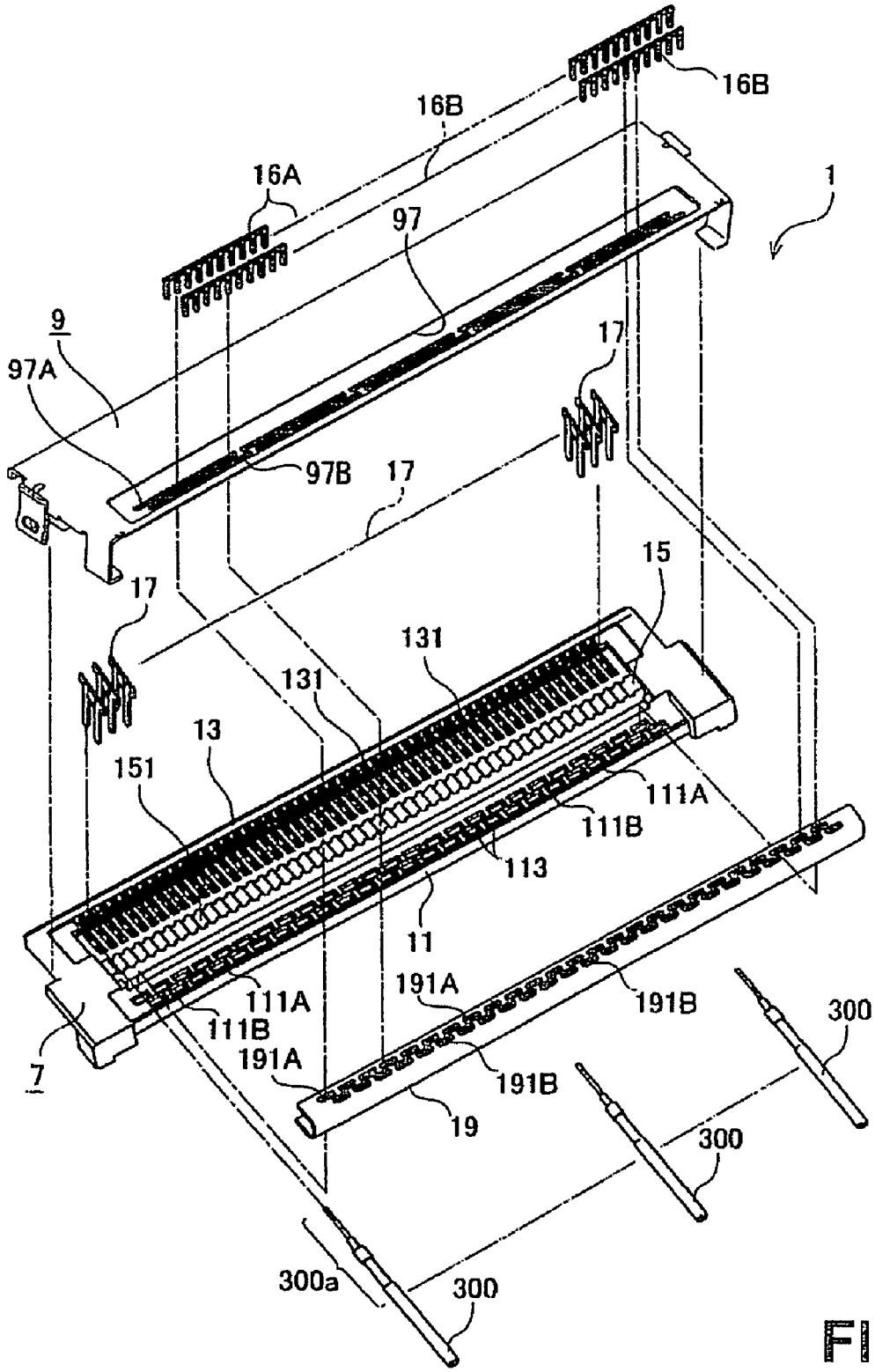
FIG. 4 is an exploded perspective view of the connector according to the present invention.
Figure 5:
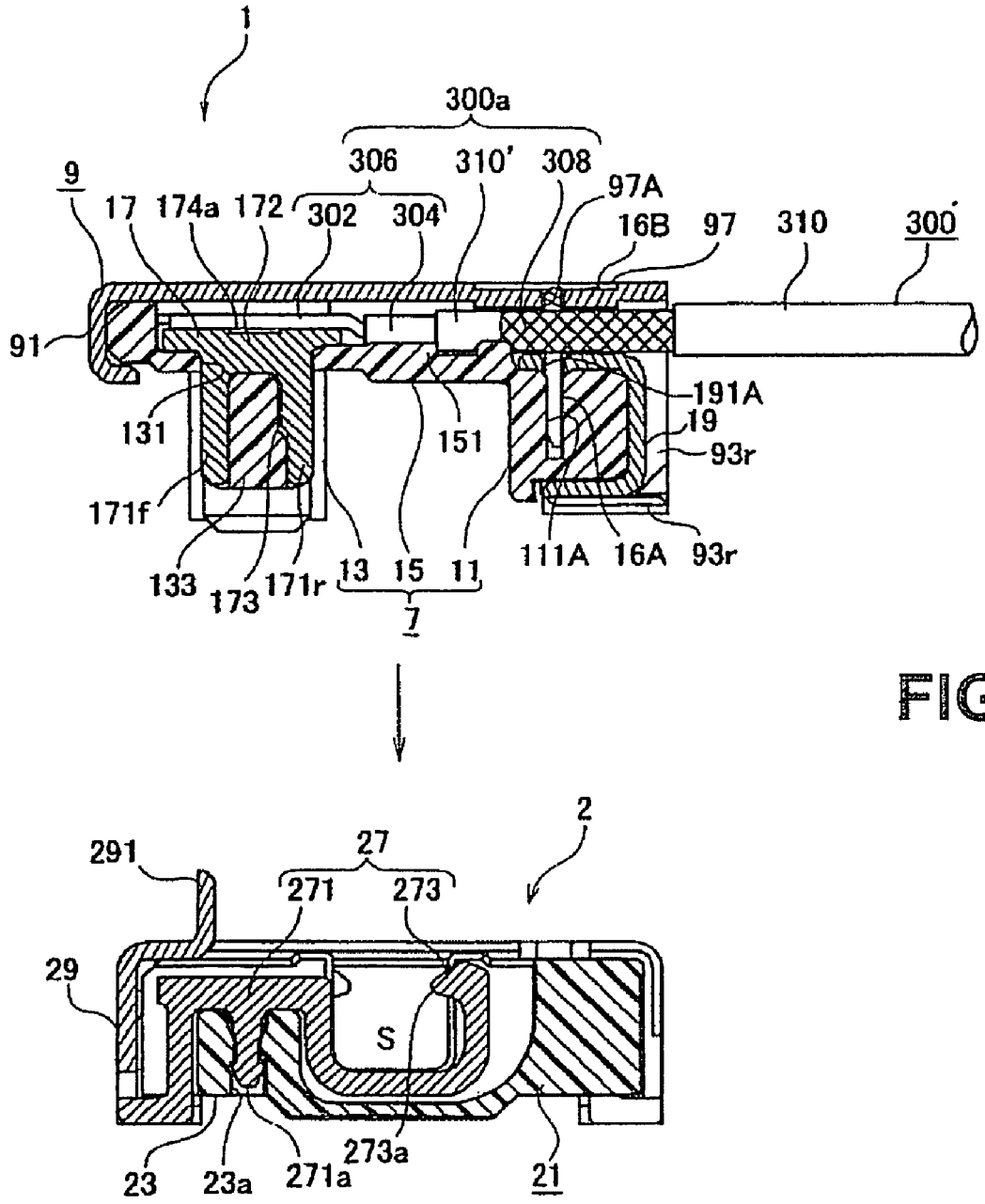
FIG. 5 is a transverse cross-sectional view through FIG. 1.
Figure 6:
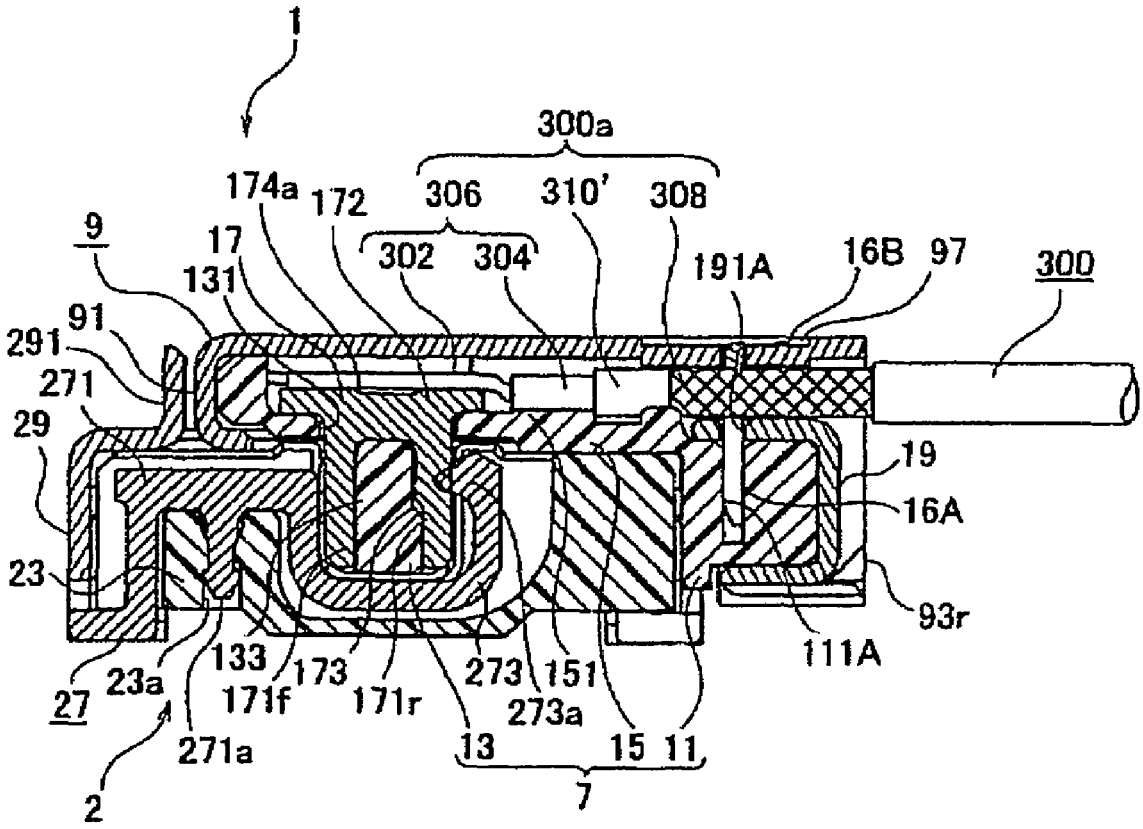
FIG. 6 is a transverse cross-sectional view through FIG. 2.
Figure 7:
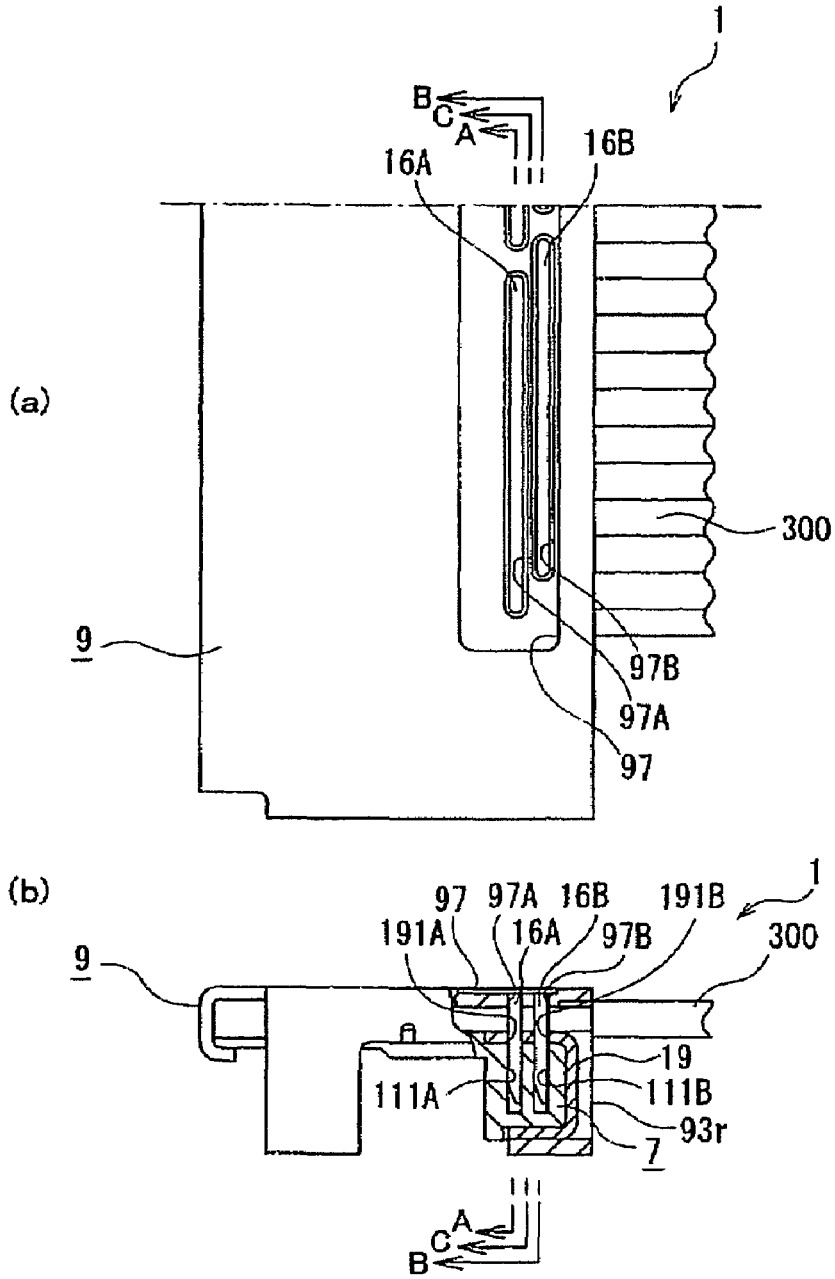
FIG. 7 is a partially cut away side view and a partially cut away plan view of the connector according to the present invention, such being collectively shown, in which part (a) is the partially cut away plan view, and part (b) is the partially cut away side view.

Further, a large number of coaxial cables 300 described above are attached between the shell 9 and the housing 7 while arranged in parallel into a flat configuration and having their respective distal end portions 300*a* (see FIGS. 5, 6) sandwiched therebetween (see FIGS. 4 through 6).

The housing 7 is made of a synthetic resin or other insulating resin. As can be seen, for example, from FIG. 4, the housing 7 has the shape of an elongated quadrangle in a plan view and disposed in a direction orthogonal to the extending direction of the coaxial cables 300. Further, the housing 7 has a cable holding portion 11 for holding the distal end portion 300*a* of the coaxial cable 300 (hereinafter referred to as the "cable distal end portion 300*a*"), a plug portion or terminal insertion portion 13 which constitutes the connecting portion with the mating connector 2 and to which the same number of terminals 17 as that of the coaxial cables 300 are inserted, and an intermediate portion 15 located intermediate the cable holding portion 11 and the terminal insertion or plug portion 13 (see FIGS. 4 through 6).

Due to the three portions described above, with the connector 1 attached to the mating connector 2, the housing 7 has, as seen in cross section, a substantially rectangular shape having a downwardly-opening depression at its central portion (see FIG. 5).

Note that, as used herein, the words "upper (top)" and "lower (bottom)" refer to the upper (top) side and the lower (bottom) side as viewed facing the drawings, and the words "front" and "rear" refer respectively, to the side on which the terminal insertion portion 13 is provided as the front and the side on which the cable holder portion 11 is provided as the rear, in the extending direction of the coaxial cable 300 as attached to the connector 1. Further, the words "left" and "right" as used herein refer to the left and right sides as viewed facing the extending direction of the coaxial cable 300. Note that the left-to-right direction is herein referred to as the width direction.

The cable holding portion 11 has a plurality of pairs of cable holders 16A, 16B each made of conductive metal and holding an outer conductor 308 of each of the plurality of coaxial cables 300 while traversing the same (see FIGS. 4 through 10), and one ground bar 19 made of conductive metal like the cable holders 16A, 16B and brought into electrical connection with the plurality of pairs of cable holders 16A, 16B.

Figure 11:
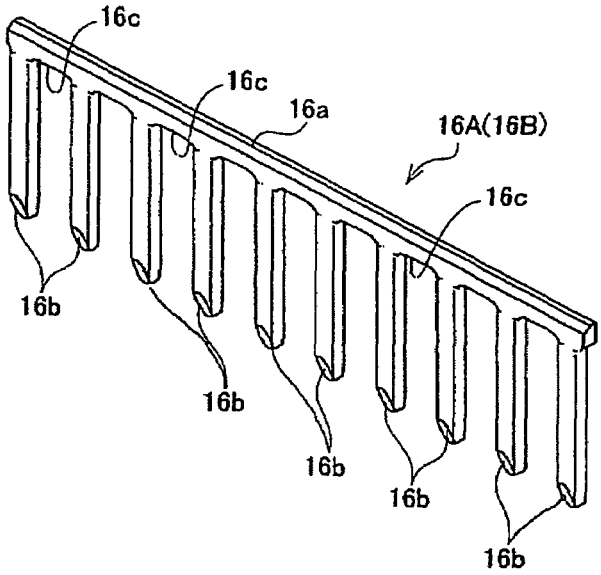
FIG. 11 is a perspective view of a cable holder.
Figure 12:
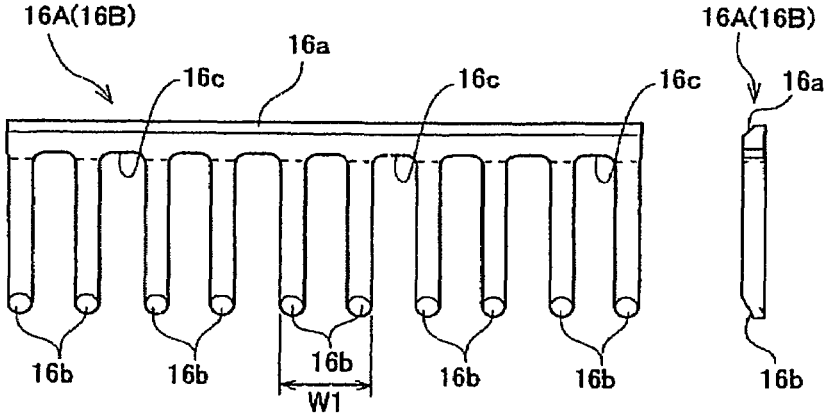
FIG. 12 is a front view and a side view of the cable holder, such being collectively shown, in which part (a) is the front view and part (b) is the side view.
Figure 33:
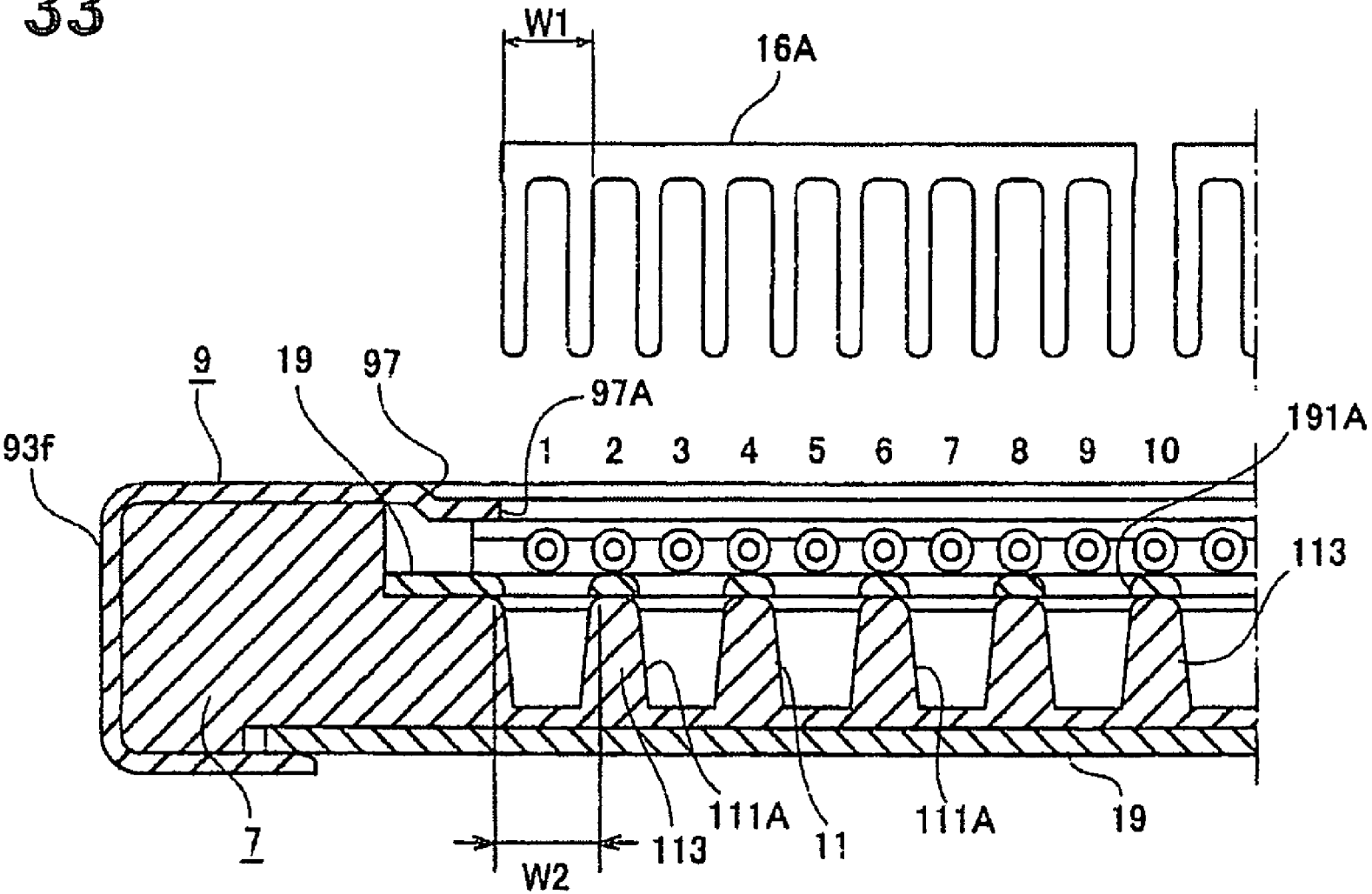
FIG. 33 is an enlarged vertical sectional view showing a state immediately prior to mounting to the housing of the cable holder for holding the odd-numbered coaxial cable as counted from the left side of the drawing.
Figure 34:
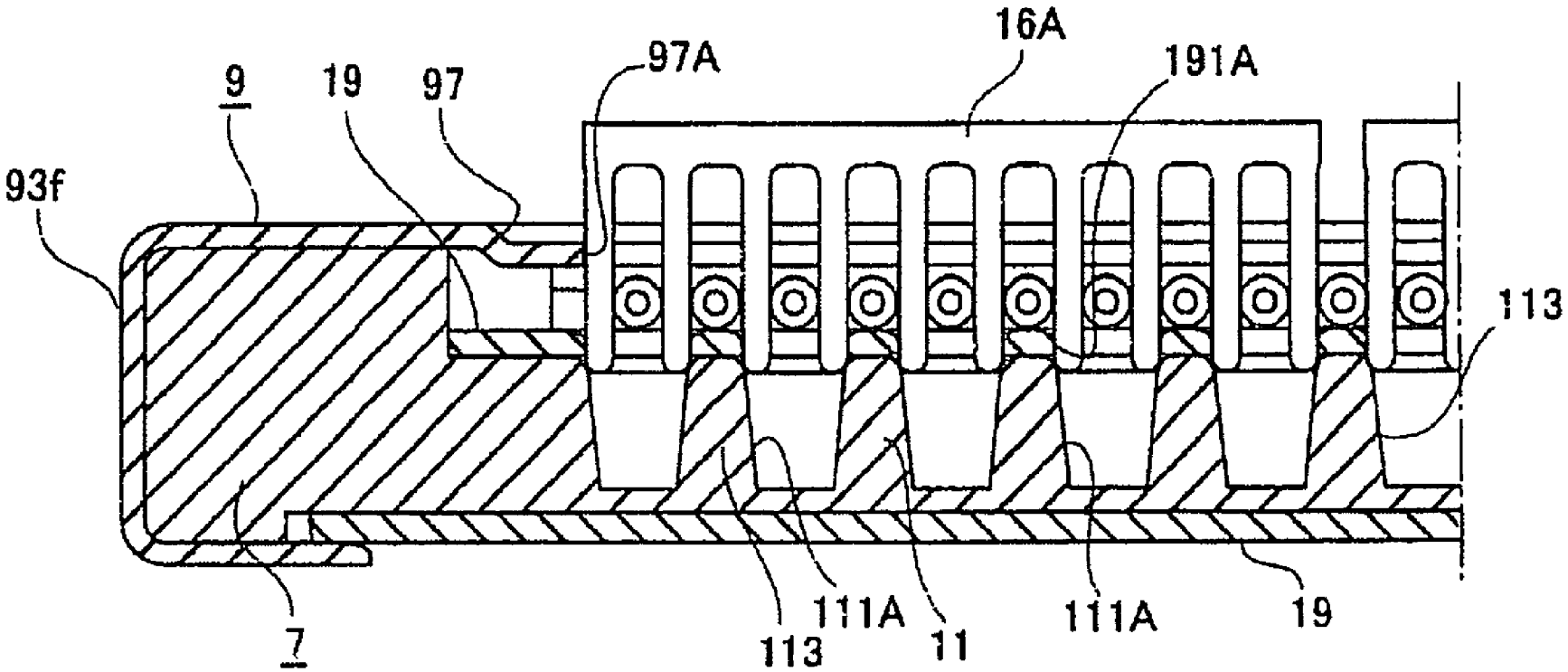
FIG. 34 is a diagram continuous from FIG. 33, showing a state immediately after mounting the cable holder to the housing.

The cable holders 16A and 16B are identical in configuration and differ only in their mounting positions in the cable holding portion 11. Accordingly, only one of the cable holders, namely the cable holder 16A, is described below. As shown in FIGS. 11 and 12, the cable holder 16A has a substrate portion 16*a* extending in the left-to-right direction, and a large number of cantilever-like legs 16*b* that are fixed at one end and free at the other end and extend downwardly in parallel from the substrate portion 16*a*. Each pair of legs comprise two legs, forming downwardly-opening and reverse-U-shaped multiple grooves 16*c* of the same number as that of the coaxial cables 300. A width W1 (see FIGS. 12 and 33) between adjacent legs 16*b* forming each groove 16*c* is set to be substantially the same as a width W2 (see FIG. 33) of each of cable holder fitting holes 111A and 111B which are provided in the housing 7 and in which the cable holders 16A, 16B are fitted.

The difference between the cable holders 16A and 16B of the pair is that the cable holder 16A serves to hold the odd-numbered coaxial cables 300A, and the cable holder 16B serves to hold the even-numbered coaxial cables 300B, as counted accordingly to the plurality of coaxial cables 300 arranged in parallel from the end (the left side in FIG. 4) of the coaxial cables 300 (see FIG. 4 and FIGS. 8 through 10).

Figure 8:
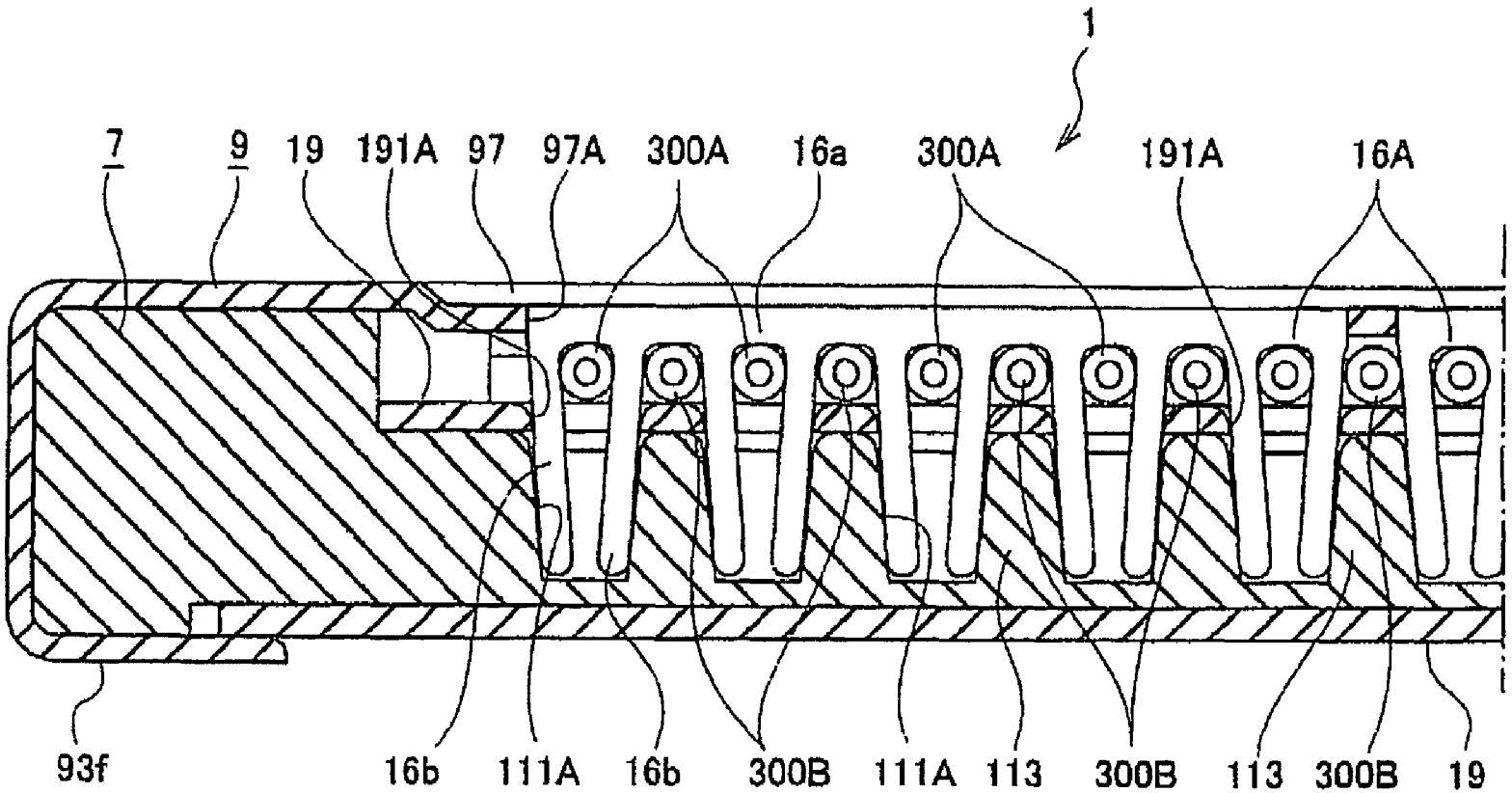
FIG. 8 is an enlarged sectional view taken along the line A-A of FIG. 7.
Figure 9:
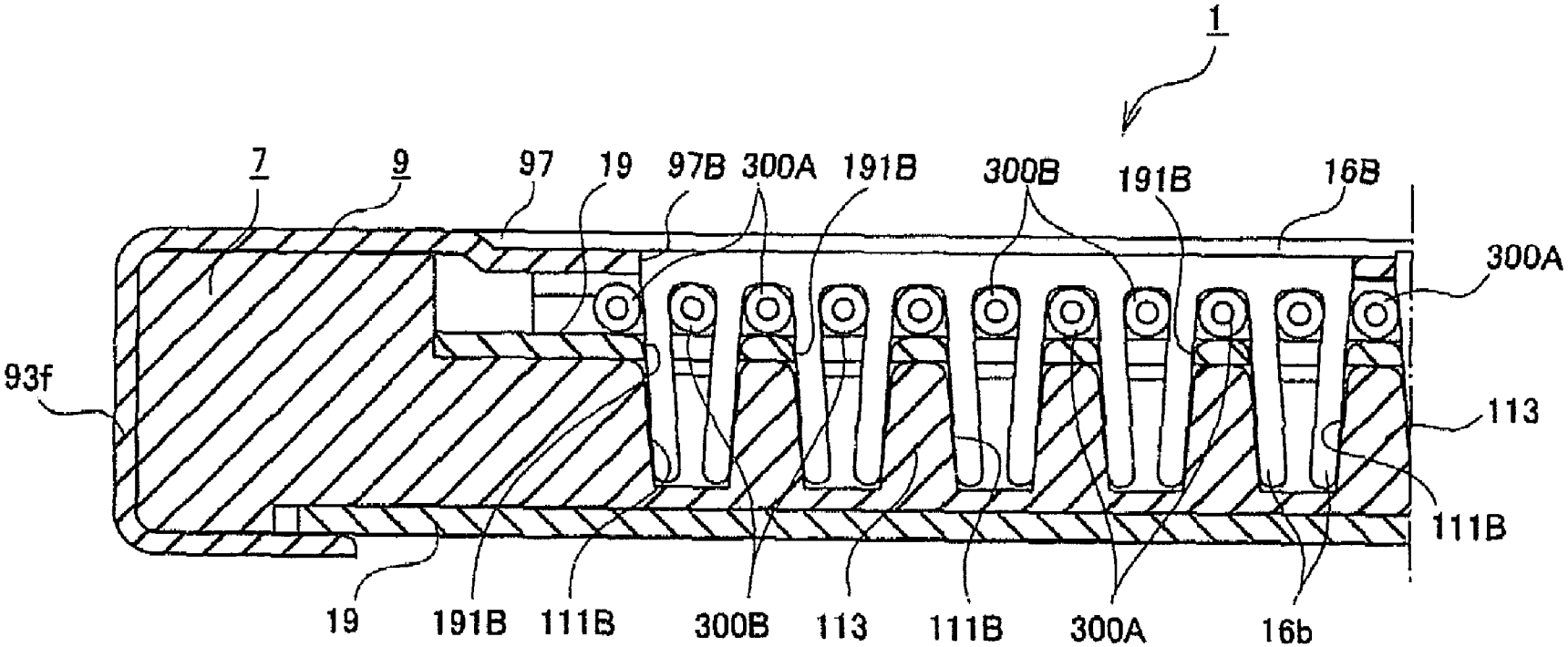
FIG. 9 is an enlarged sectional view taken along the line B-B of FIG. 7.
Figure 10:
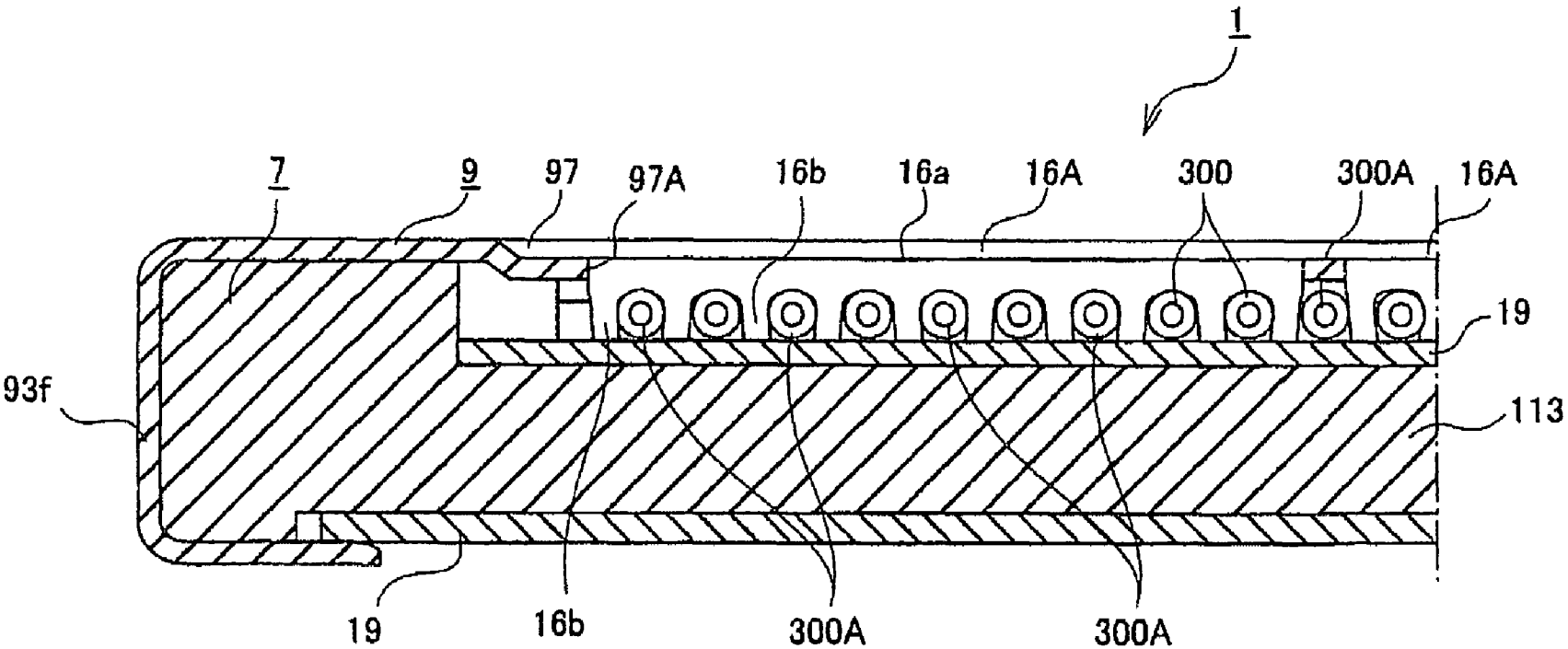
FIG. 10 is an enlarged sectional view taken along the line C-C of FIG. 7.

Further, the cable holders 16A and 16B are respectively associated with a large number of the cable holder fitting holes 111A and 111B provided in the cable holding portion 11 (see FIGS. 4, 8 and 9). Of the cable holders 16A and 16B, respective sets of a pair of adjacent legs 16*b*, 16*b* are inserted into the cable holder fitting holes 111A and 111B.

These sets of the pair of legs 16*b*, 16*b* are simultaneously inserted into the multiple cable holder fitting holes 111A and 111B. Note that each set of the pair of legs 16*b*, 16*b* is referred to as the double-legged portion. The total number of each of the cable holder fitting holes 111A and 111B is the same as that of the coaxial cables 300. As seen in vertical section with respect to the front-to-rear direction, the cable holder fitting holes 111A and 111B are each shaped like an inverted truncated isosceles triangle and tapered such that its opening is large at the top and small at the bottom (see FIGS. 8, 9, 33, 34). A partition wall 113 is provided between adjacent cable holder fitting holes 111A and between adjacent cable holder fitting holes 111B. (FIG. 4.)

The cable holders 16A and 16B are engaged with the cable holder fitting holes 111A, 111B, respectively, in order to hold the coaxial cables 300 in a state of being in contact with the outer conductor 308 of each coaxial cable 300, by the double-legged portion and the substrate portion 16*a* in the form of straddling and nipping the coaxial cables 300 (see FIGS. 5 and 6).

The cable holders 16A, 16B are arranged such that they are parallel to each other in the front-to-rear direction but are offset from each other in the left-to-right direction (see FIGS. 4, 8 and 9). To realize this arrangement, a large number of cable holder fitting holes 111A and 111B, into which the cable holders 16A, 16B are respectively inserted, are formed linearly and equidistant from each other along the rear edge of the housing 7 such that they are parallel to each other in the front-to-rear direction but offset from each other in the left-to-right direction (see FIGS. 4, 8, 9, 24 and 25).

By inserting the cable holders 16A, 16B into the cable holder fitting holes 111A, 111B, respectively, the outer conductor 308 of each coaxial cable 300 is sandwiched from above and below by, and electrically connected with, the ground bar 19 and the cable holders 16A, 16B (see FIGS. 5, 6, 8, 10, 33 and 34).

Figure 26:
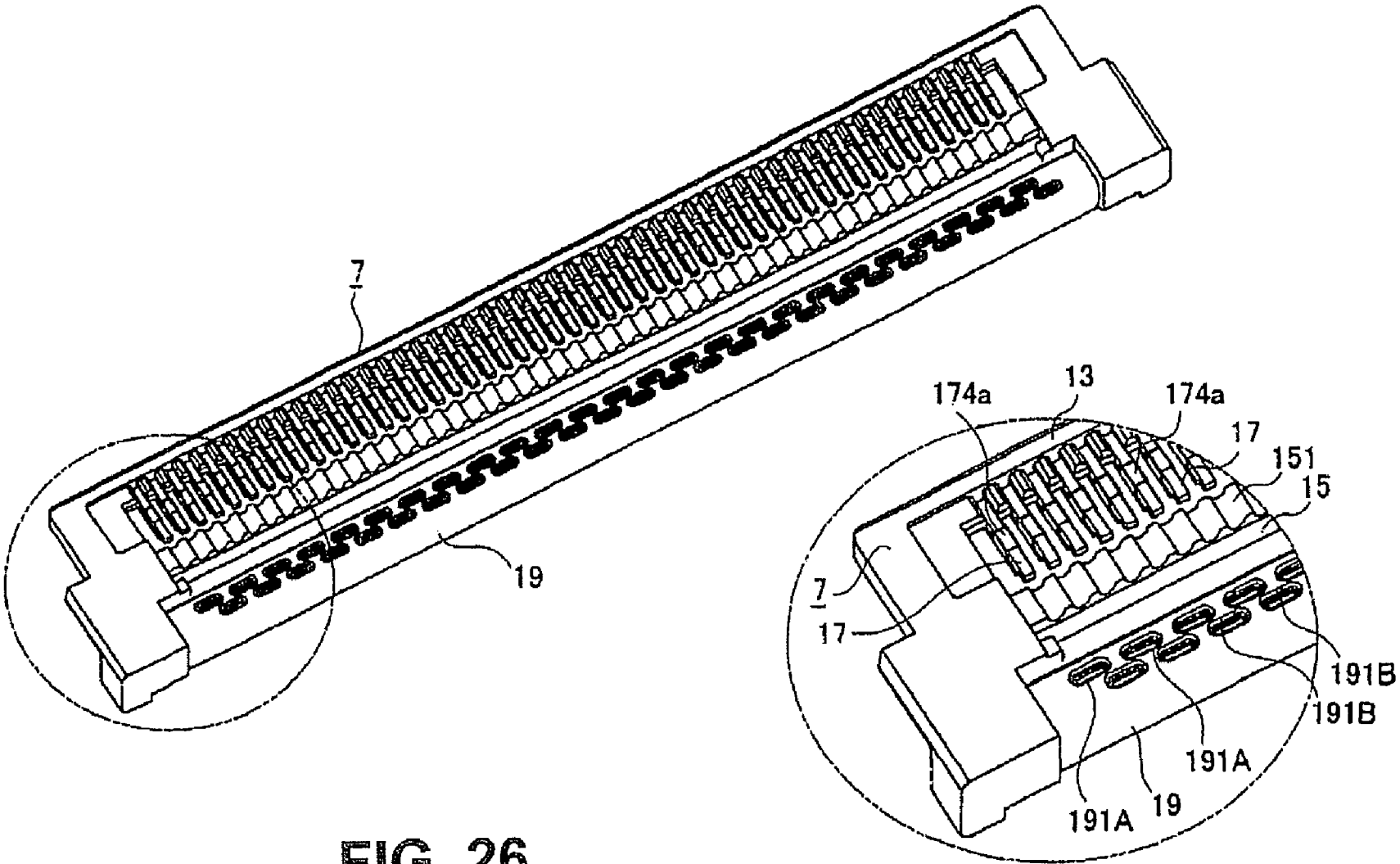
FIG. 26 is a perspective view showing a state in which a ground bar is attached to the housing of FIG. 24, and an enlarged view of the essential portion thereof.

The ground bar 19 is mounted so as to hold the cable holding portion 11 from the rear side of the cable holding portion 11 from three directions, that is, from above, below, and the rear (see FIG. 4). Accordingly, the ground bar 19 has a hollow square pole-like configuration that is open at the front and at the right and left, such that it has the shape of a horizontally placed channel steel as seen in cross section. Further, through-holes 191A and 191B, which are opposed to the cable holder fitting holes 111A and 111B, respectively, are formed in the upper surface of the ground bar 19 in the same number as that of the cable holder fitting holes 111A and 111B (FIGS. 4, 6, 26.)

It will be appreciated that a large number of through-holes 191A and 191B are formed linearly and at equal intervals from each other such that they are parallel in the front-to-rear direction, but offset in the left-to-right direction, from each other.

Accordingly, upon mounting the ground bar 19 from the rear of the cable holding portion 11, the cable holder fitting hole 111A and the cable holder fitting hole 111B are located coaxially in the top-to-bottom direction with respect to the through-hole 191A and the through-hole 191B, respectively (see FIGS. 8, 9).

The terminal insertion portion 13 of the housing 7 is provided with insertion holes 131 into which the terminals 17 are press fitted from above (see FIGS. 4 through 6). Each insertion hole 131 is an elongated hole extending in the front-to-rear direction. Provided inside the insertion hole 131 (see FIGS. 5, 6) is a terminal holding portion 133 for holding the terminal 17 fitted thereon.

The terminal, which is connected to an inner conductor 302 of the coaxial cable 300 by soldering, is formed by machining a thin metal plate. Further, as shown in FIGS. 4, 5, 6, 13, 14, 18, 19, 20 and 35, the terminal 17 is sized and shaped to be inserted in the terminal insertion portion 13. The terminal has a body portion that has a termination surface and at least one contacting portion extending therefrom. The illustrated terminal 17 has multiple contacting portions including a front upright leg 171*f* and a rear upright leg 171*r*, which are spaced from each other in the front-to-back direction. A body or connecting portion 172 is provided on top of those legs and connects the two legs 171*f*, 171*r* at their one ends, thus defining a substantially gate-like double-legged configuration in this illustrated embodiment.

Figure 13:
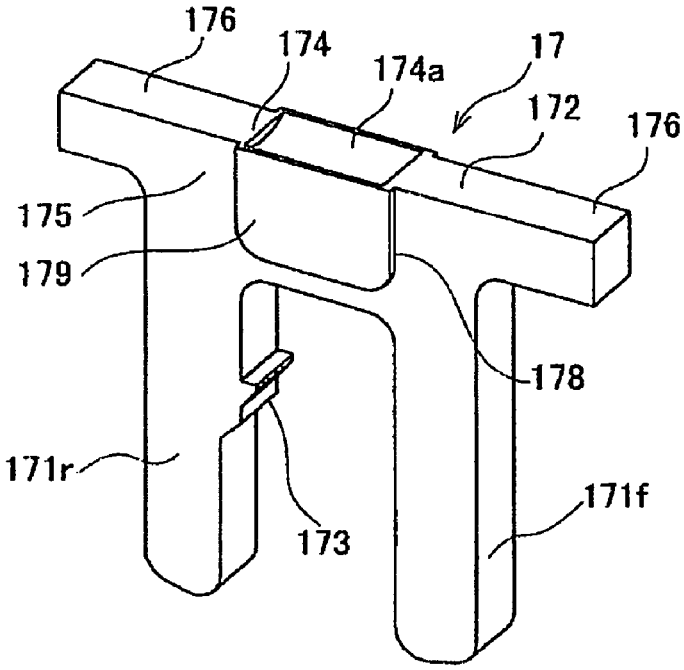
FIG. 13 is a perspective view of a terminal as seen from one direction.
Figure 14:
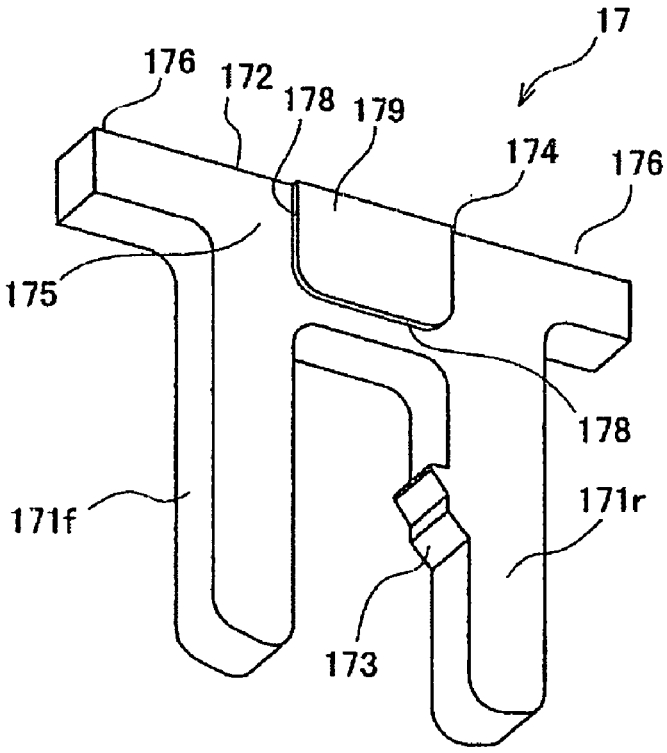
FIG. 14 is a perspective view of the terminal as seen from another direction from that of FIG. 13.
Figure 15:
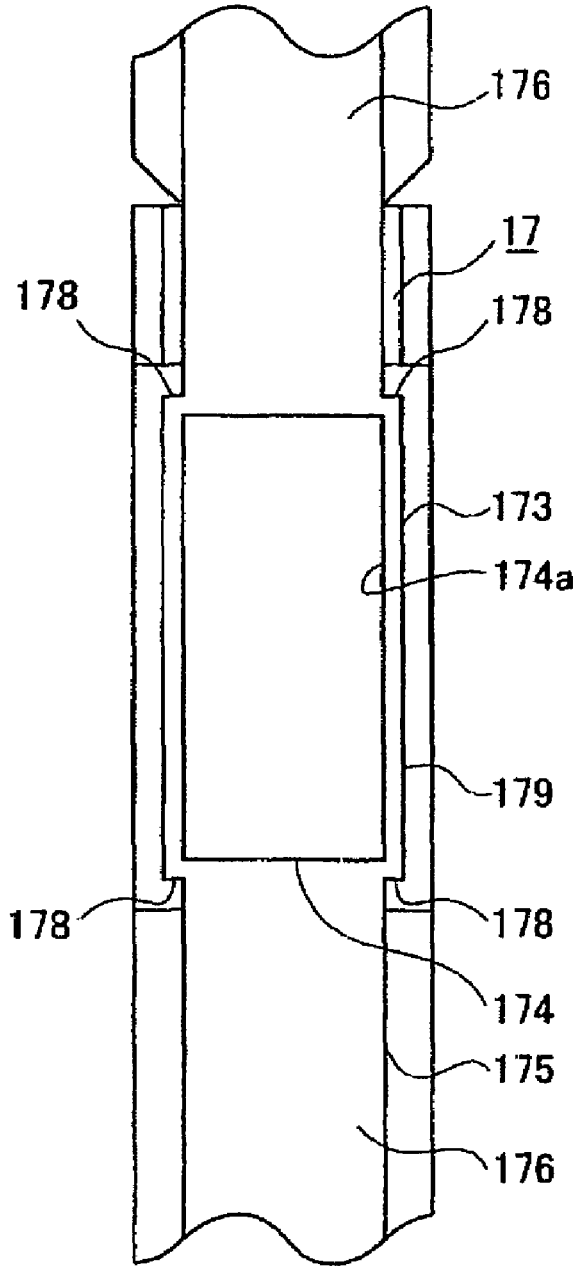
FIG. 15 is an enlarged plan view of a selected portion including a portion of a housing which includes the terminal.
Figure 16:
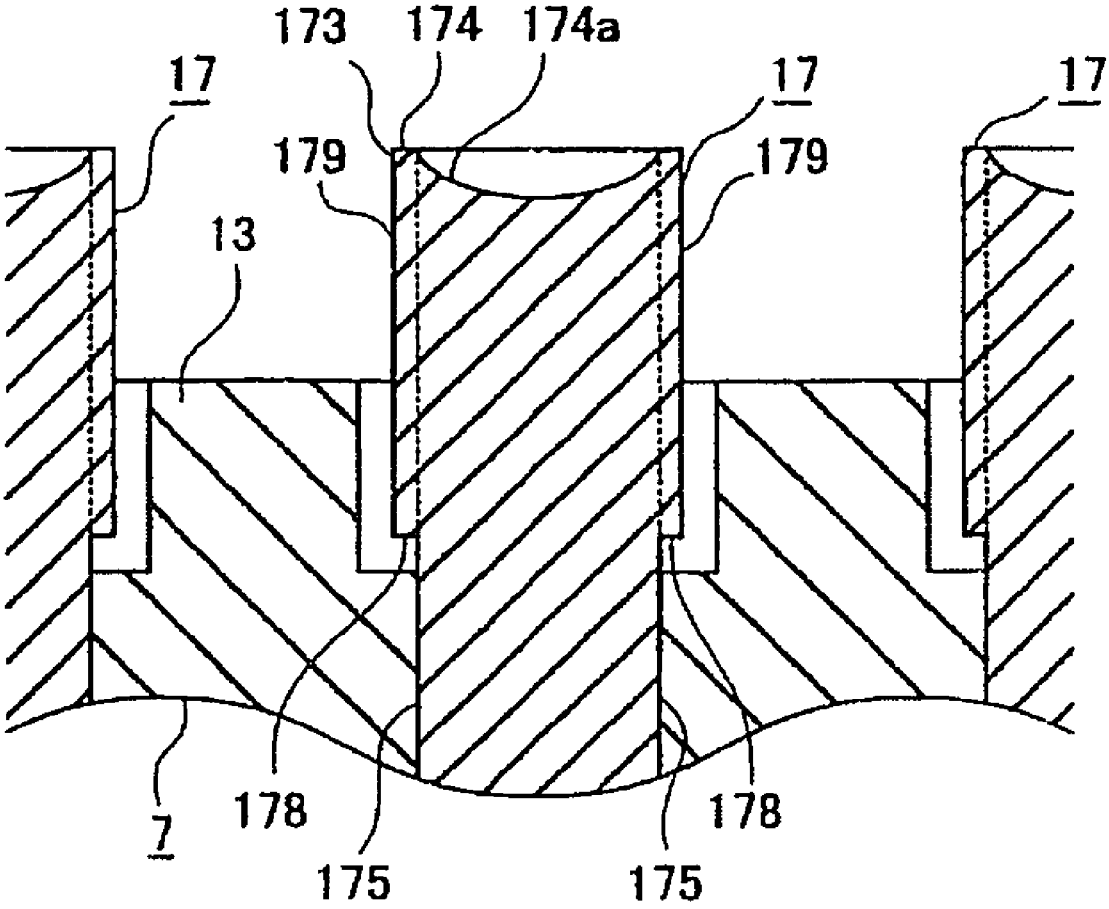
FIG. 16 is a cross-sectional view of a selected portion of FIG. 15.
Figure 17:
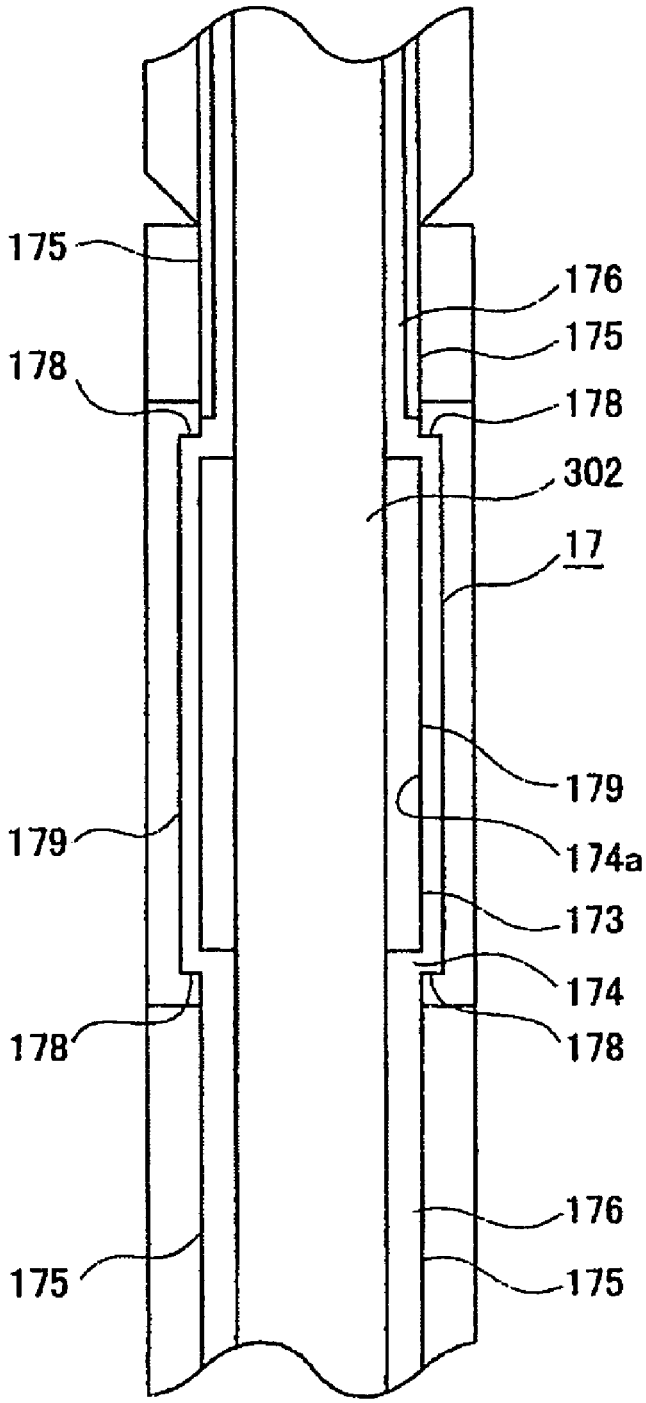
FIG. 17 is an enlarged plan view of a selected portion illustrating the case where an inner conductor of a coaxial cable is placed in the terminal of FIG. 14.
Figure 18:
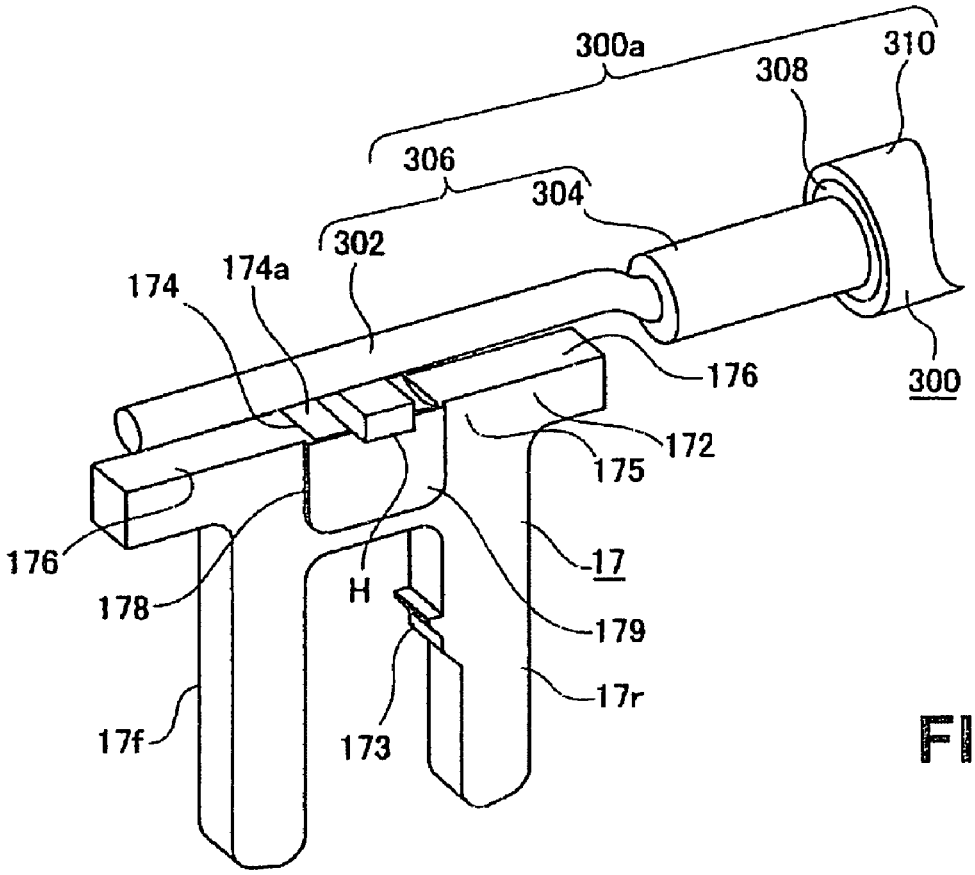
FIG. 18 is a perspective view showing a first step of an illustrated soldering procedure for soldering the terminal and the coaxial cable together.
Figure 19:
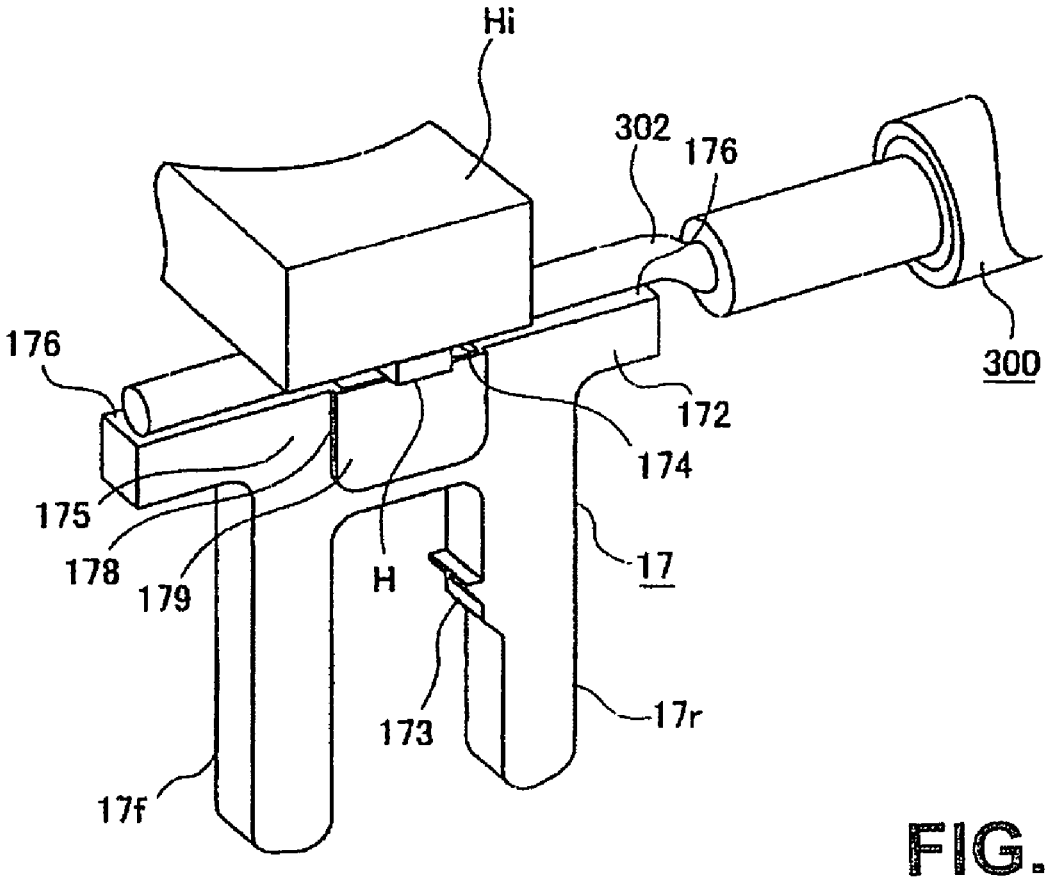
FIG. 19 is a perspective view showing a second step of the illustrated soldering procedure for soldering the terminal and the coaxial cable together.

Formed on the inner side of the rear upright leg 171*r* is a locking member 173 for preventing dislodging of the terminal 17 inserted in the insertion hole 131 (FIGS. 13, 14). The terminal 17 is received into the insertion hole 131 of the terminal insertion portion 13 from the distal end of the terminal 17, the distal end being the free end side of the upright legs 171*f*, 171*r*. When the terminal 17 is inserted into the insertion hole 131, the locking member 173 bites into the terminal holding portion 133 (FIGS. 5, 6), thereby preventing dislodging of the terminal 17.

As shown in FIGS. 13 through 23, the connecting portion 172 includes a soldering region 174 that is an area to be soldered onto the inner conductor 302 of the coaxial cable 300. Formed in the soldering region 174 is a recess or an elongated depression 174*a* taking the form of a pocket or well extending in the longitudinal direction of the connecting portion 172 and adapted to receive a fillet. As seen in cross section, the depression 174*a* has an arcuate bottom surface (see FIGS. 13 and 21). The depression 174*a* is formed by stamping.

The soldering region 174 is formed in one surface of the connecting portion 172 on the side opposite to inserting direction of the terminal 17 (the upper surface in FIG. 13). Further, the soldering region 174 has a wide lateral width as compared with the other region of the connecting portion 172 of the terminal 17, namely a termination surface or flat surface region 176 where the soldering region 174 is not formed (FIGS. 13-18). By thus forming the soldering region 174 that is laterally wide, a path, track or step 178 is formed at the boundary portion with another termination surface or flat surface region 176 (see FIGS. 13 through 19).

Due to the step 178, there is formed on either side surface of the connecting portion 172 a sidewall or stepped portion 179 that is an island-like region extending continuously to the soldering region 174 and protruded with respect to a side surface region 175 that is the other side surface region of either side surface (FIGS. 13-20). The stepped portion 179 is formed by punching the non-stepped portion.

As shown in FIGS. 4-6, the intermediate portion 15 of the housing 7 has an inner insulator installation portion 151 where an inner insulator 304 of the coaxial cable 300 is installed. The same number of the inner insulator installation portions 151 as that of the coaxial cables 300 are formed in a continuous manner in the left-to-right direction. Further, the inner insulator installation portion 151 has a substantially horizontal S-shaped sectional configuration so as to provide a good seating for the inner insulator 304 when it is installed in the inner insulator installation portion 151. Regarding the sectional configuration, the curvature of the portion where the inner insulator 304 is installed is set to be the same as the curvature of the inner insulator 304 (FIGS. 4, 24-27).

The shell 9 of the connector 1 is made of conductive metal. Further, since the shell 9 serves to cover the housing 7, like the housing, the shell 9 is shaped as an elongated quadrangle in plan view (FIG. 4). Further, the front edge of the shell 9 is formed as a folded portion 91 bent into a fold toward the rear side (FIG. 5). The rear portions of the opposite side edges of the shell 9 extend downwardly, forming side arms 93*f*, 93*r* having their respective distal ends folded inwardly so as to embrace the cable holding portion 11 of the housing 7 from both sides (FIGS. 1, 4). At this time, both the side arms 93*f*, 93*r* are in abutment with the bottom portion of the ground bar 19 for electrical connection therewith (FIGS. 5, 8, 9-10). Further, formed in the opposite side edges at a position closer to the front edge are locking members 95*f*, 95*r* for mounting the connector 1 to the mating connector 2 (FIGS. 1-2).

The locking members 95*f*, 95*r* each has a substantially U-shaped vertical section with its downwardly extending tongue member folded back upwardly at the central portion thereof. The locking members 95*f*, 95*r* exhibit a resilient force when applied with an external force acting to close the opening of the U-shape. Further, the distal ends of the locking members 95*f*, 95*r* are bent slightly sideways.

Formed substantially over the rear half portion of the ceiling surface of the shell 9 is a shallow flat recess 97 extending in the left-to-right direction along the rear edge of the ceiling surface. As shown in FIG. 4, through-holes 97A, 97B, into which the cable holders 16A, 16B are respectively inserted, are formed in the flat recess 97 in the same number as the number of the cable holders 16A, 16B (which is ten in the drawing). While, like the through-holes 191A, 191B and the cable holder fitting holes 111A, 111B, the through-holes 97A, 97B are also formed parallel to each other in the front-to-back direction but offset from each other in the left-to-right direction (FIGS. 4, 8 and 9), the through-holes 97A, 97B are larger than those holes. When fitting the shell 9 over the housing 7, the through-holes 97A, 97B of the shell 9 are opposed to the through-holes 191A, 191B of the ground bar 19 and the cable holder fitting holes 111A, 111B of the housing 7, respectively (FIGS. 5 & 6).

The length of the respective legs 16*b* of the cable holders 16A and 16B, the depth dimension of the cable holder fitting holes 111A, 111B of the housing 7, and other various dimensions are selected such that when, as described above, the cable holders 16A and 16B are fit-engaged with the cable holder fitting holes 111A, 111B (FIGS. 5 and 6), the substrate portions 16*a* of the cable holders 16A and 16B are exposed and located within the through-holes 97A/97B (FIGS. 5, 6, 8 and 9). Further, the substrate portion 16*a* is formed slightly larger than the through-holes 97A, 97B with respect to the width direction. Accordingly, when the cable holders 16A and 16B are fully fit-engaged with the housing 7, the substrate portion 16*a* comes into an interference-fit with the through-holes 97A/97B, thereby preventing dislodging and providing secure electrical connection between the shell 9 and the cable holders 16A, 16B.

Typical mounting steps (1) through (6) for the connector 1 described above now are summarized with reference to FIGS. 24-32 and their associated drawings. It is to be noted from FIG. 5 that the illustrated coaxial cable 300 has a distal end portion 300*a* comprising a signal line 306 having a conductor 302 which is at an inner location within the cable. This inner conductor is exposed and not covered by inner insulator 304, or by another inner sheath, which is an intermediate sheath or sheath-remaining portion 310'. Also not covering these components is an outer shield or outside conductor 308 and an outside insulator 310. In the illustrated arrangement, the distal edge of the sheath 310' is situated immediately to the right or rear of the signal line 306, the distal edge of the outside conductor 308 is situated close to the right or rear of the sheath 310', and the distal edge of the outer insulator 310 is situated close to the right or rear of the outside conductor 308. In this construction, the outer insulator 310 remains where shown, and the outside conductor 308 is exposed where only the outer insulator 310 is not present, such as by having been stripped off (FIGS. 5 & 6).

Figure 24:
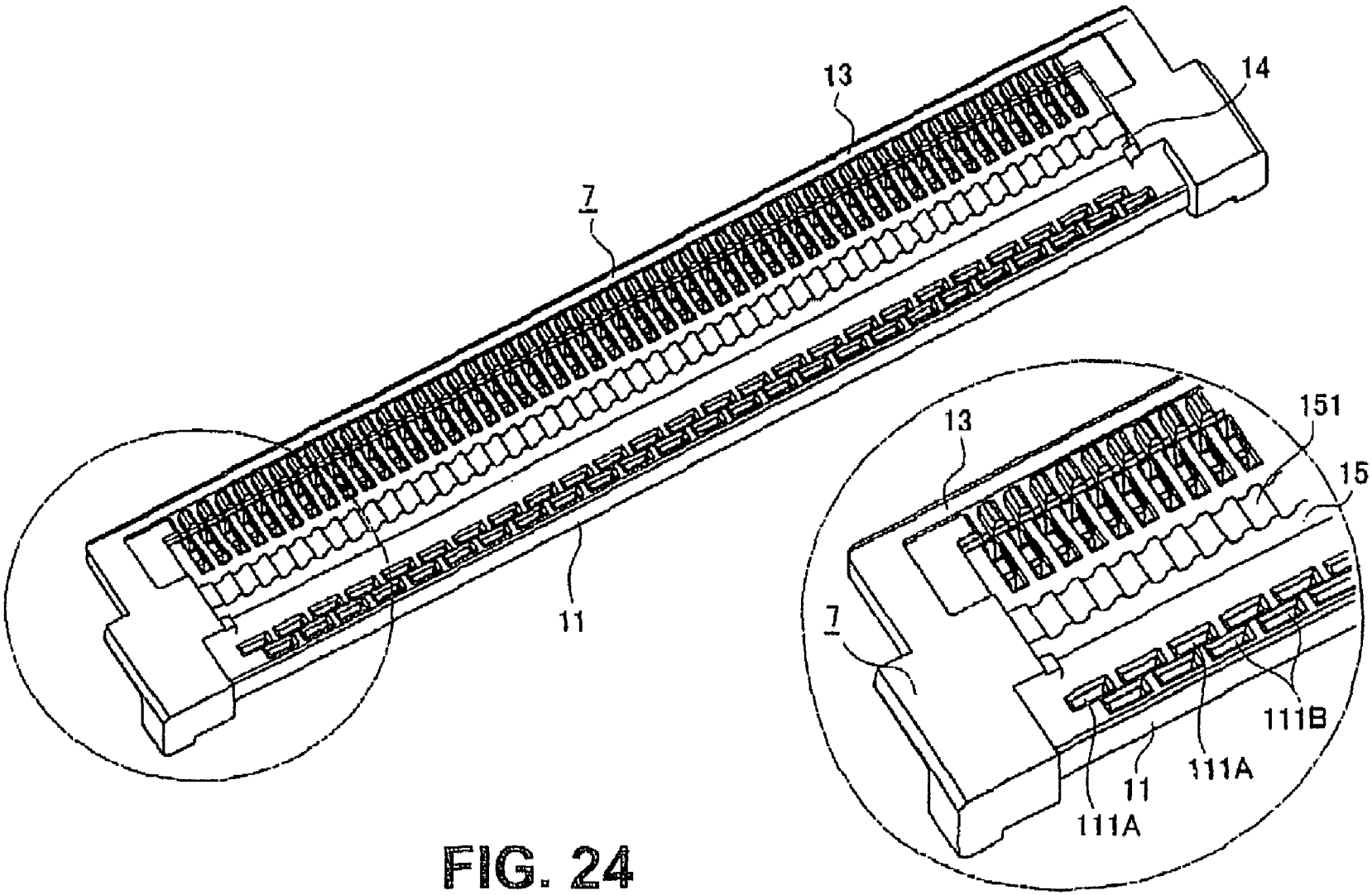
FIG. 24 is a perspective view of the housing, and an enlarged view of the essential portion thereof.
Figure 25:
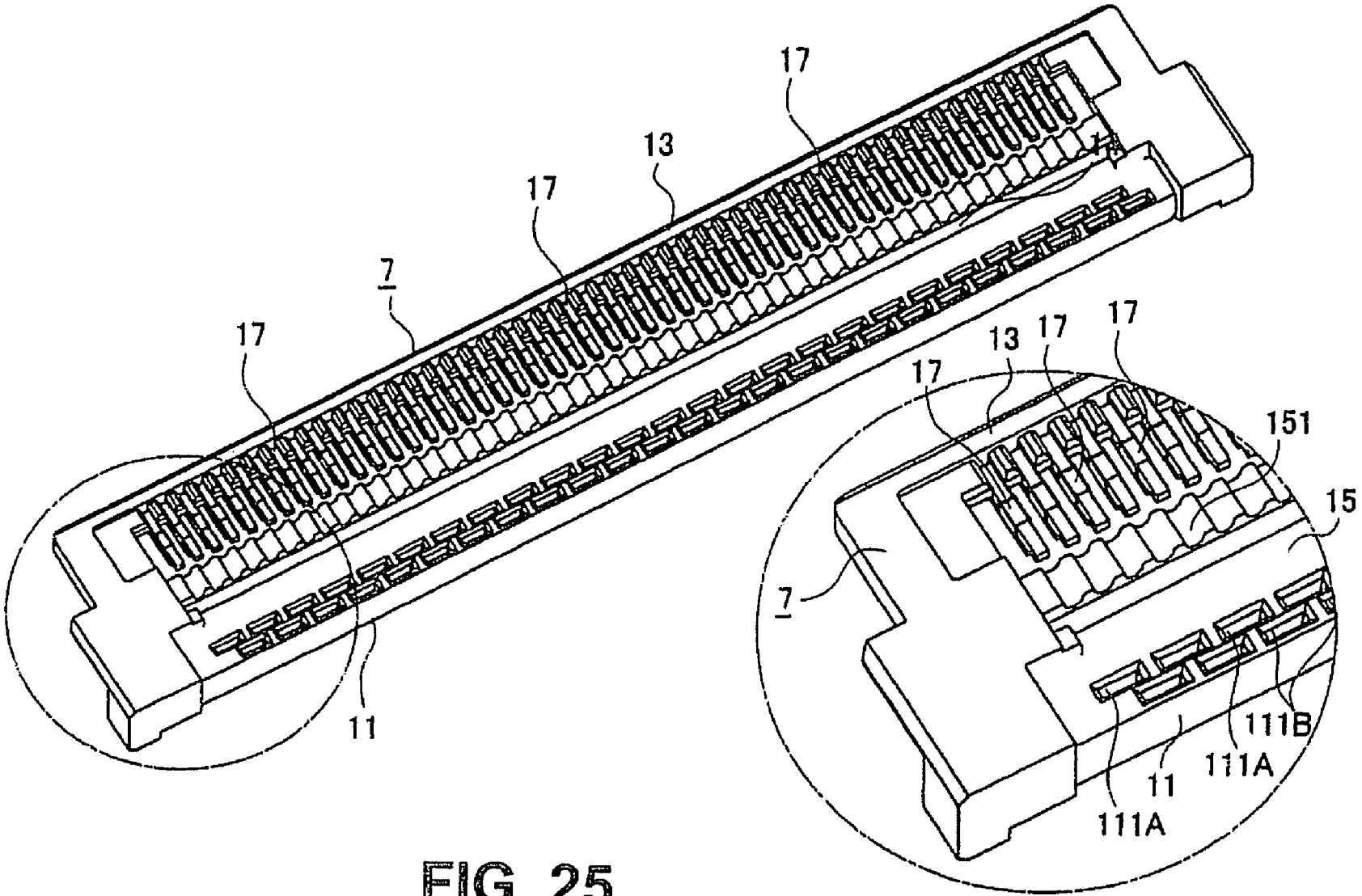
FIG. 25 is a perspective view showing a state in which the terminal is attached to the housing of FIG. 24, and an enlarged view of the essential portion thereof.

In proceeding with step (1) the terminal 17 is inserted into the insertion hole 131 of the housing 7, thereby attaching the terminal 17 to the housing 7. This is illustrated in FIGS. 24 and 25.

A next step, or step (2), attaches the ground bar 19 to the cable holding portion 11. This is illustrated in FIGS. 25 & 26.

By step (3), the terminal 17 and the inner conductor 302 of the coaxial cable 300 are soldered together (FIGS. 18-23, 27). In FIGS. 18-23, reference symbol H denotes solder (linear solder) or a block of solder. Further, reference symbol Hi denotes solder fusing device, which can take the form of a pulse heater or a soldering iron or other heating unit suitable for soldering.

The soldering procedures are as follows. As shown in FIGS. 18-21, the solder H is placed on the depression 174*a* so as to be orthogonal to the longitudinal direction of the terminal 17, and the inner conductor 302 of the coaxial cable 300 is placed on the solder H so as to be in parallel to the terminal 17. This illustrates the soldering procedure of step (1).

Next, as shown in FIGS. 19-22, the solder fusing device Hi is placed on the inner conductor 302 and subjected to heating, thus melting the solder. This illustrates the soldering procedure of step (2).

Figure 20:
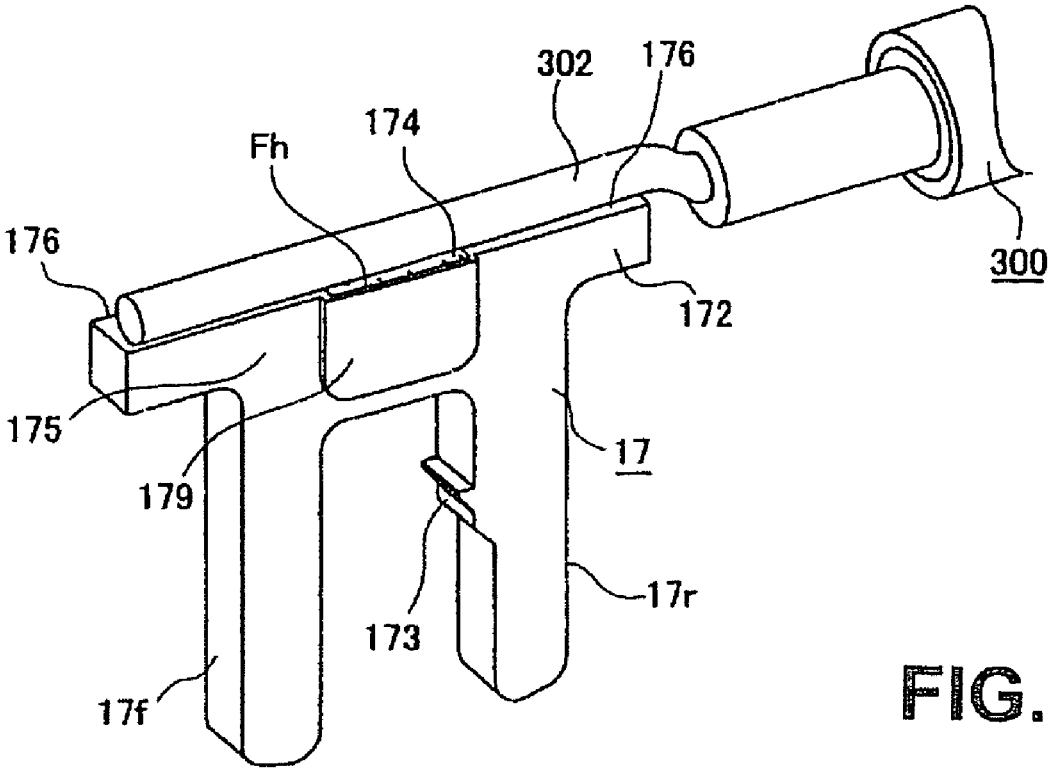
FIG. 20 is a perspective view showing a third step of the illustrated soldering procedure for soldering the terminal and the coaxial cable together.
Figure 21:
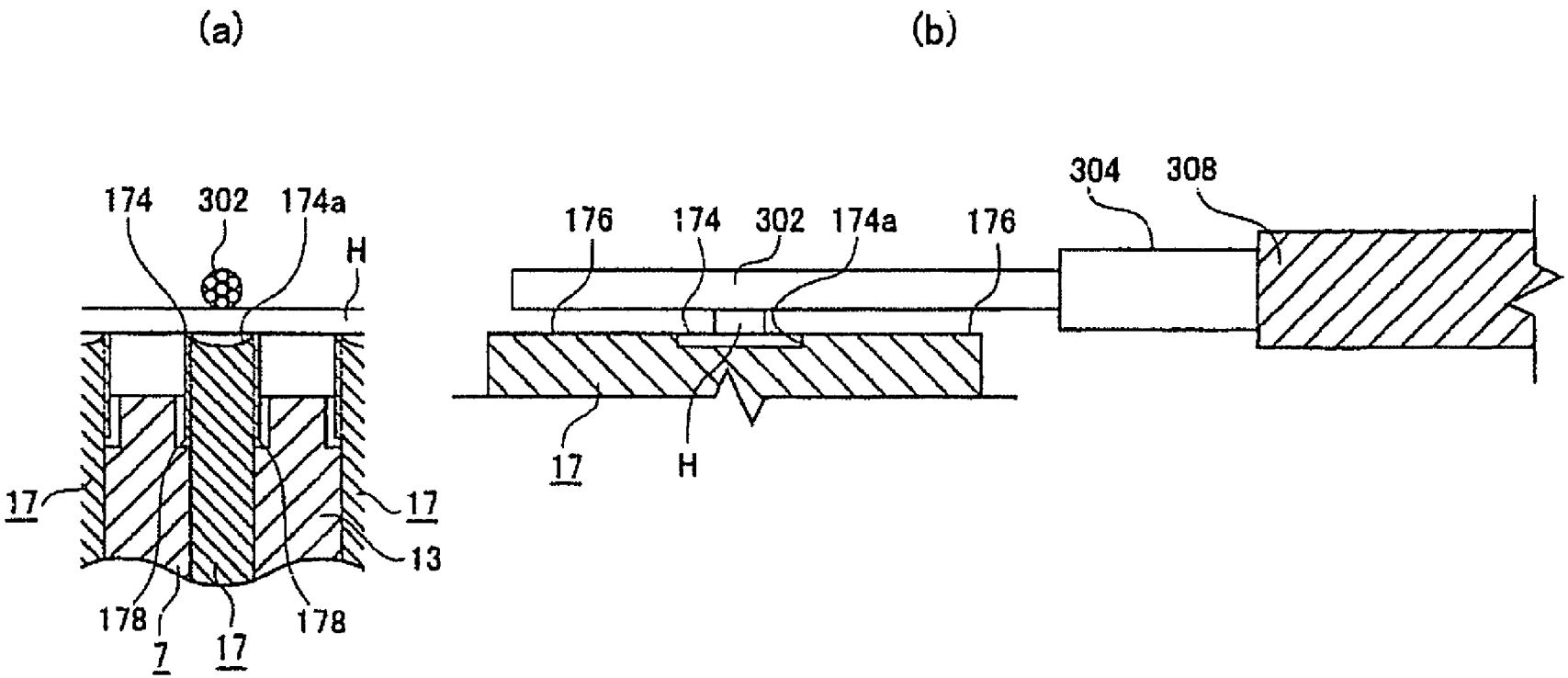
FIG. 21 is a longitudinal sectional view of a selected portion and a transverse sectional view of a selected portion FIG. 18 shown together, in which part (a) is the longitudinal sectional view and part (b) is the transverse sectional view.
Figure 22:
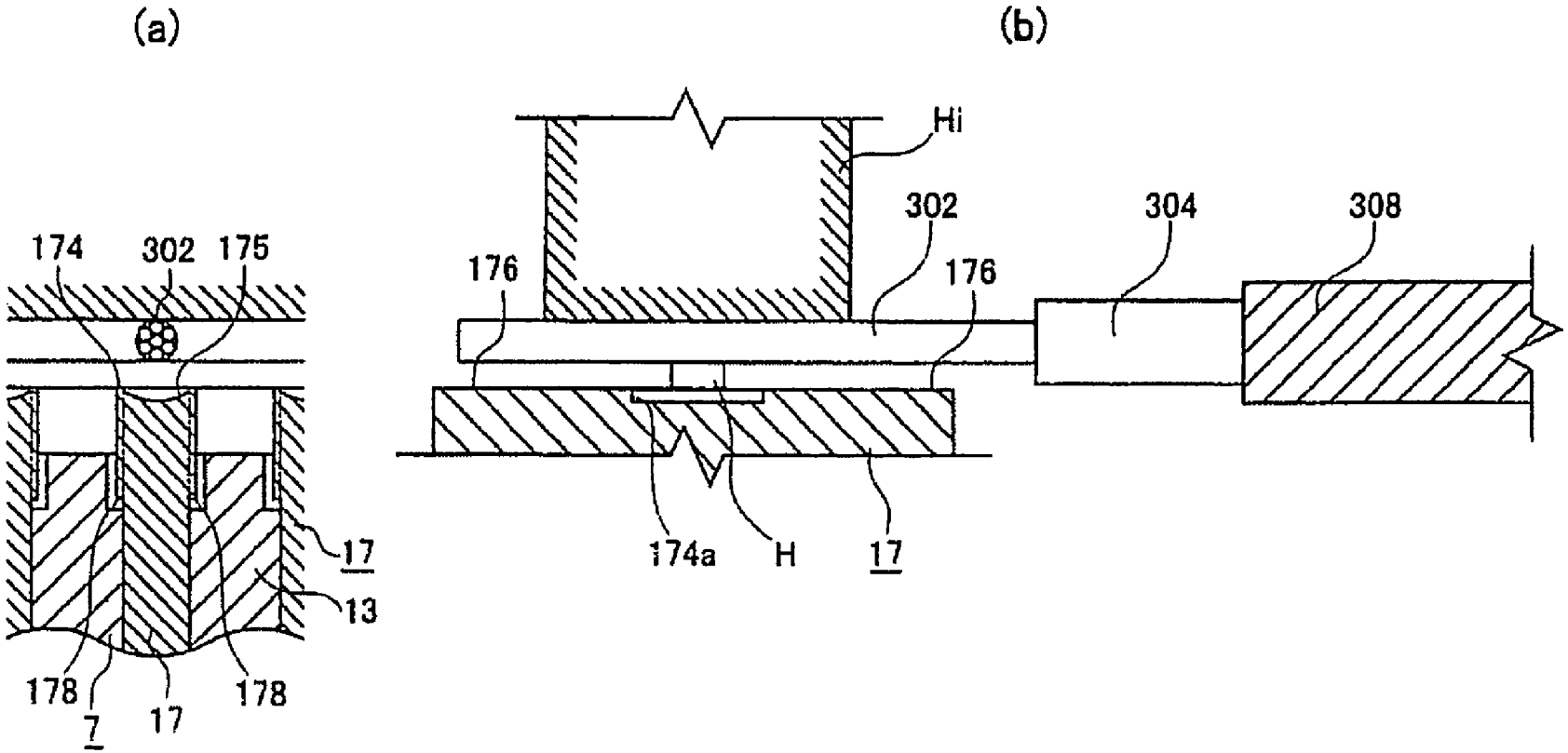
FIG. 22 is a longitudinal sectional view of a selected portion and a transverse sectional view of a selected portion of FIG. 19 shown together, in which part (a) is the longitudinal sectional view and part (b) is the transverse sectional view.
Figure 23:
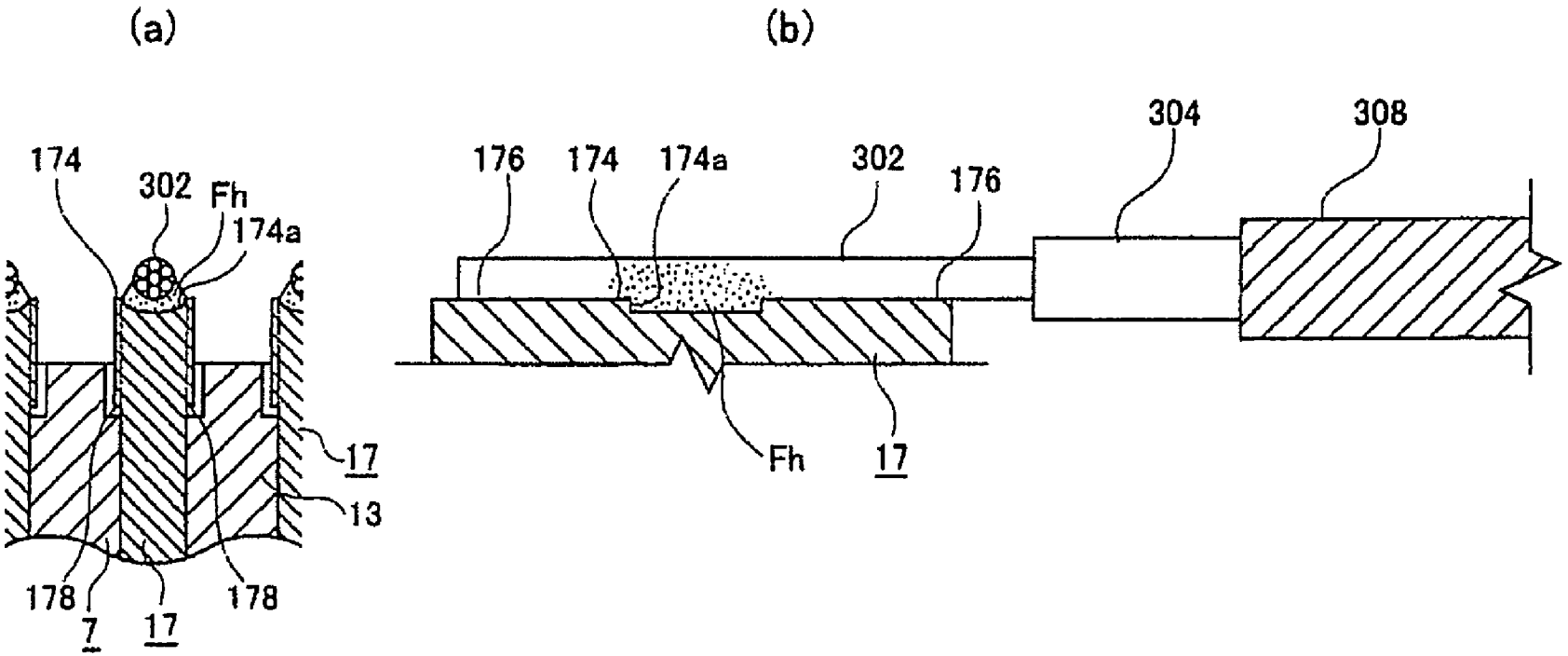
FIG. 23 is a longitudinal sectional view of a selected portion and a transverse sectional view of a selected portion of FIG. 20 shown together, in which part (a) is the longitudinal sectional view and part (b) is the transverse sectional view.

As shown in FIGS. 20 and 23, the fused solder H enters the depression 174*a* where it forms a fillet Fh (gradation portion), and the soldering is complete. This illustrates the soldering procedure of step (3).

Figure 27:
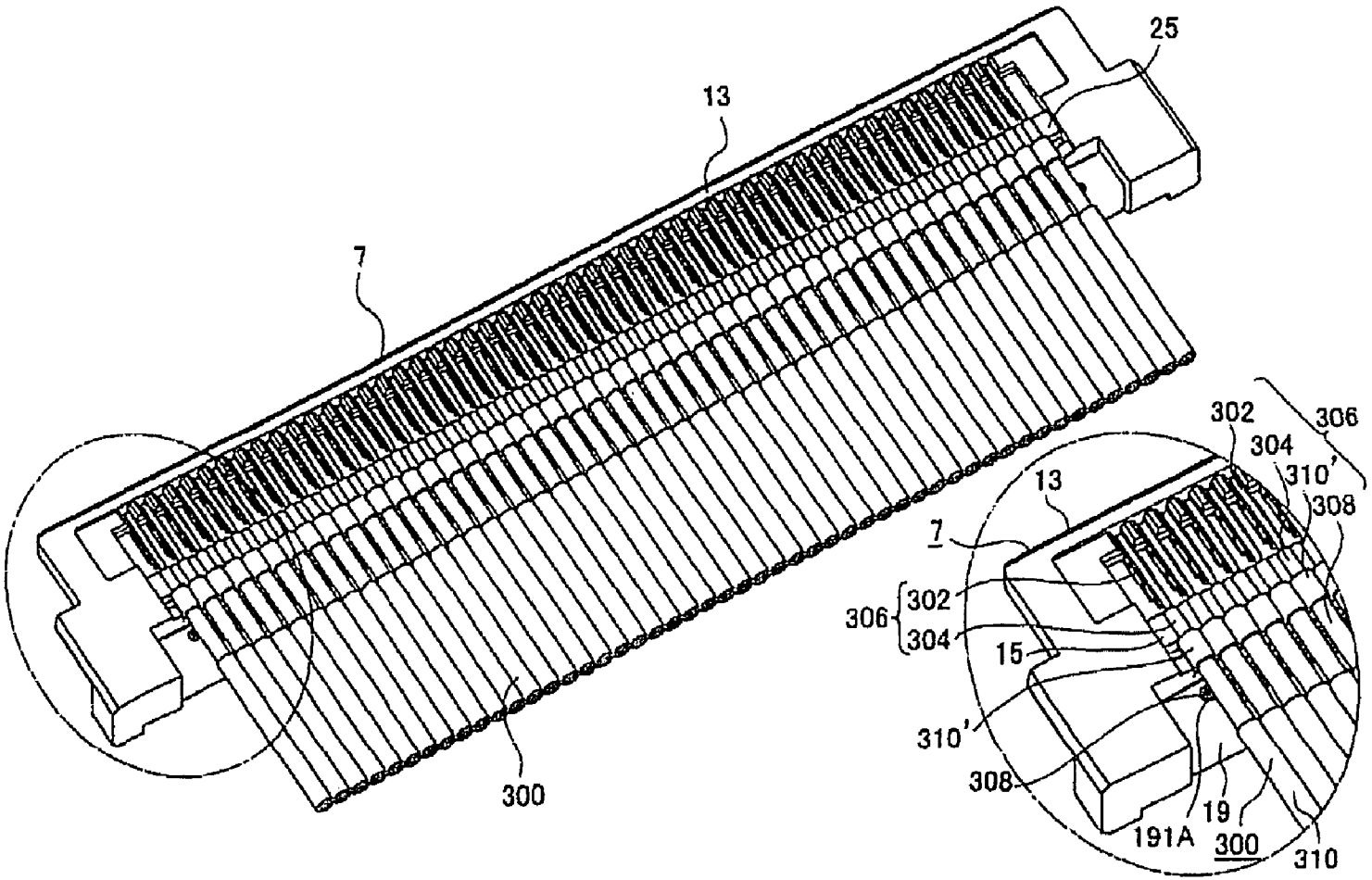
FIG. 27 is a perspective view showing a state in which the coaxial cable is attached to the housing of FIG. 26, and an enlarged view of the essential portion thereof.
Figure 28:
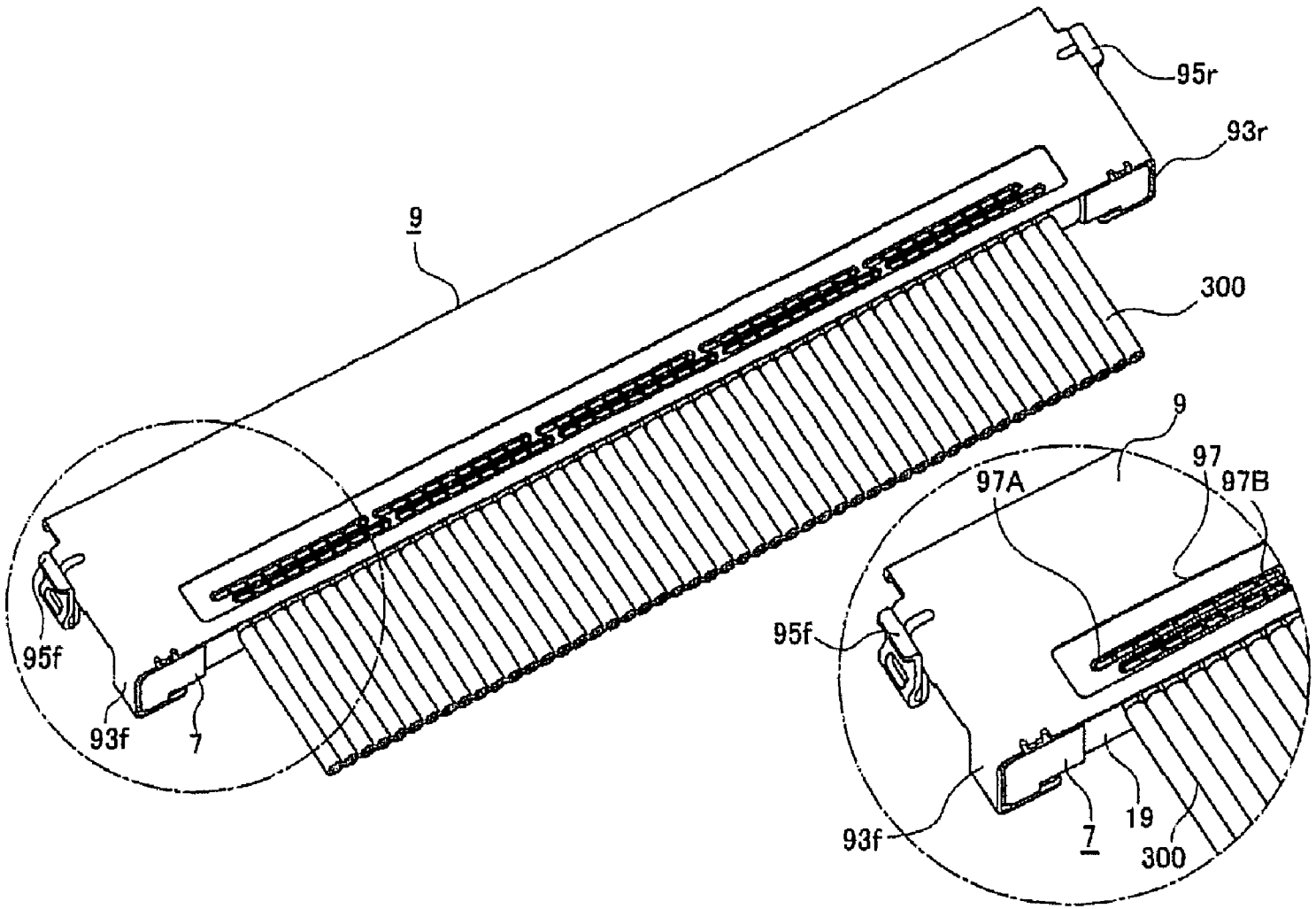
FIG. 28 is a perspective view showing a state in which a shell is attached to the housing of FIG. 27, and an enlarged main portion view of the essential portion thereof.
Figure 29:
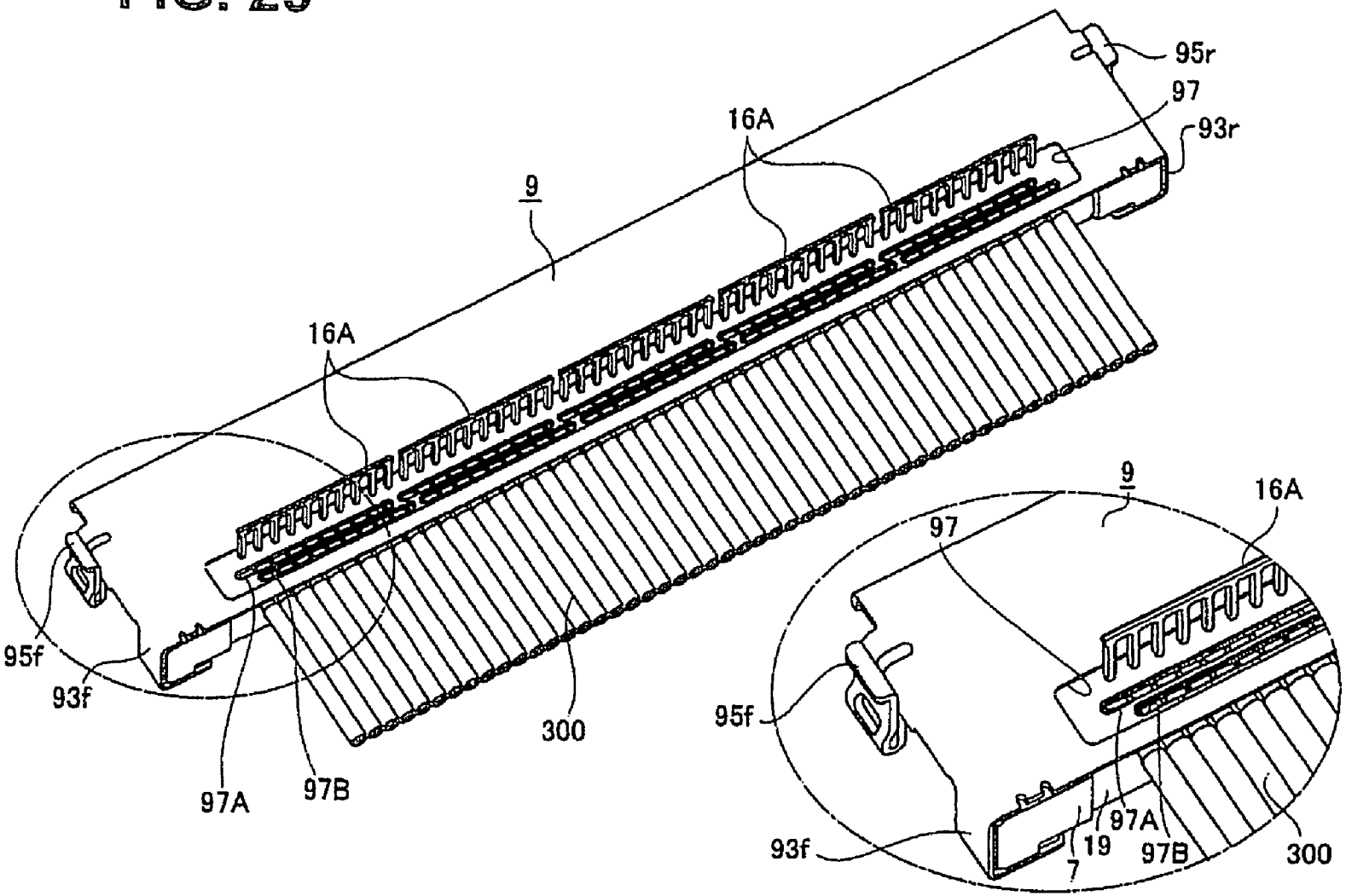
FIG. 29 is a perspective view showing a state immediately prior to mounting to the housing of FIG. 28 a cable holder for holding an odd-numbered coaxial cable as counted from the left side of the drawing, and an enlarged view of a selected portion thereof.
Figure 30:
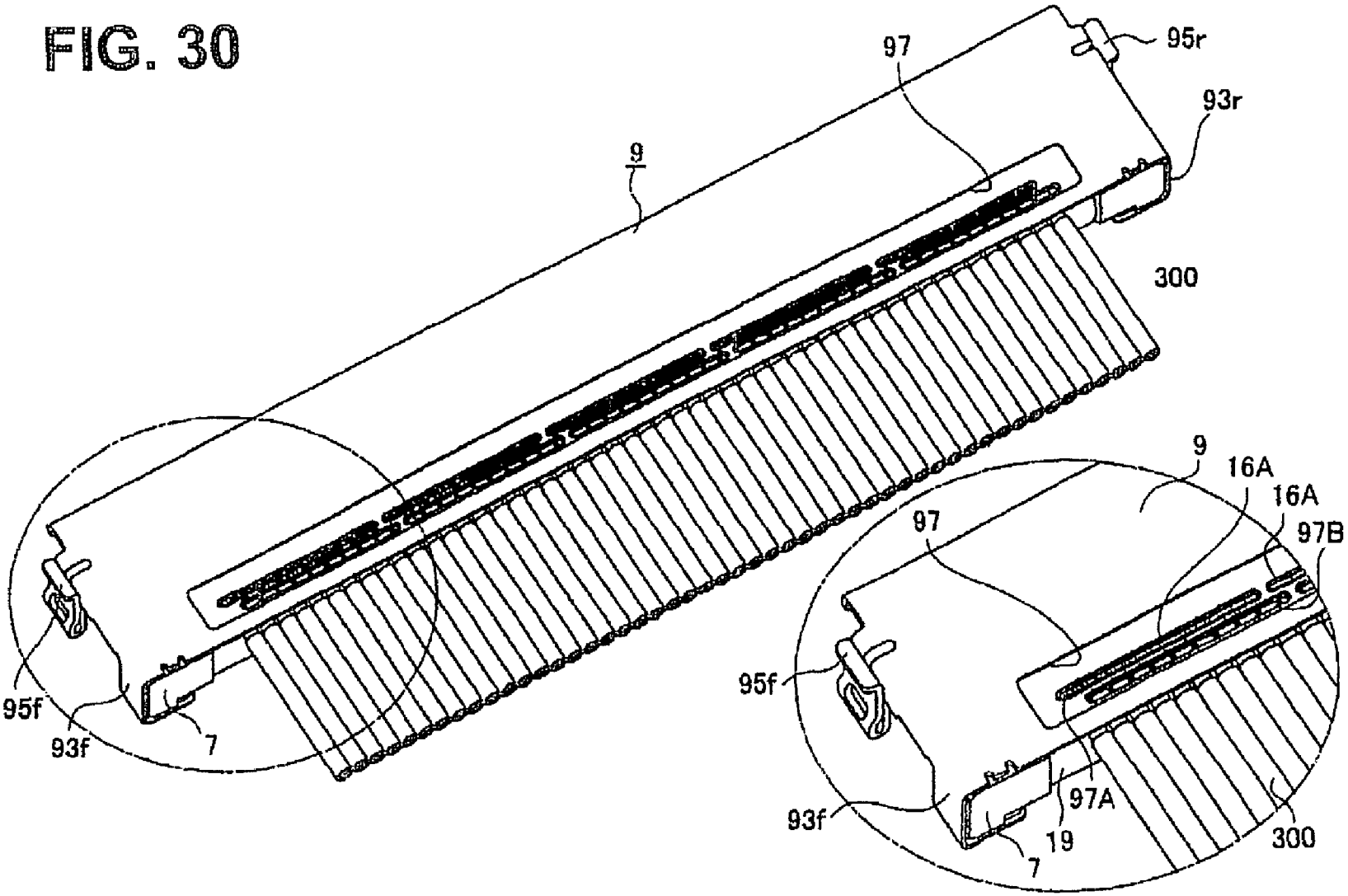
FIG. 30 is a perspective view showing a state immediately after mounting the cable holder of FIG. 29 to the housing, and an enlarged view of a selected portion thereof.
Figure 31:
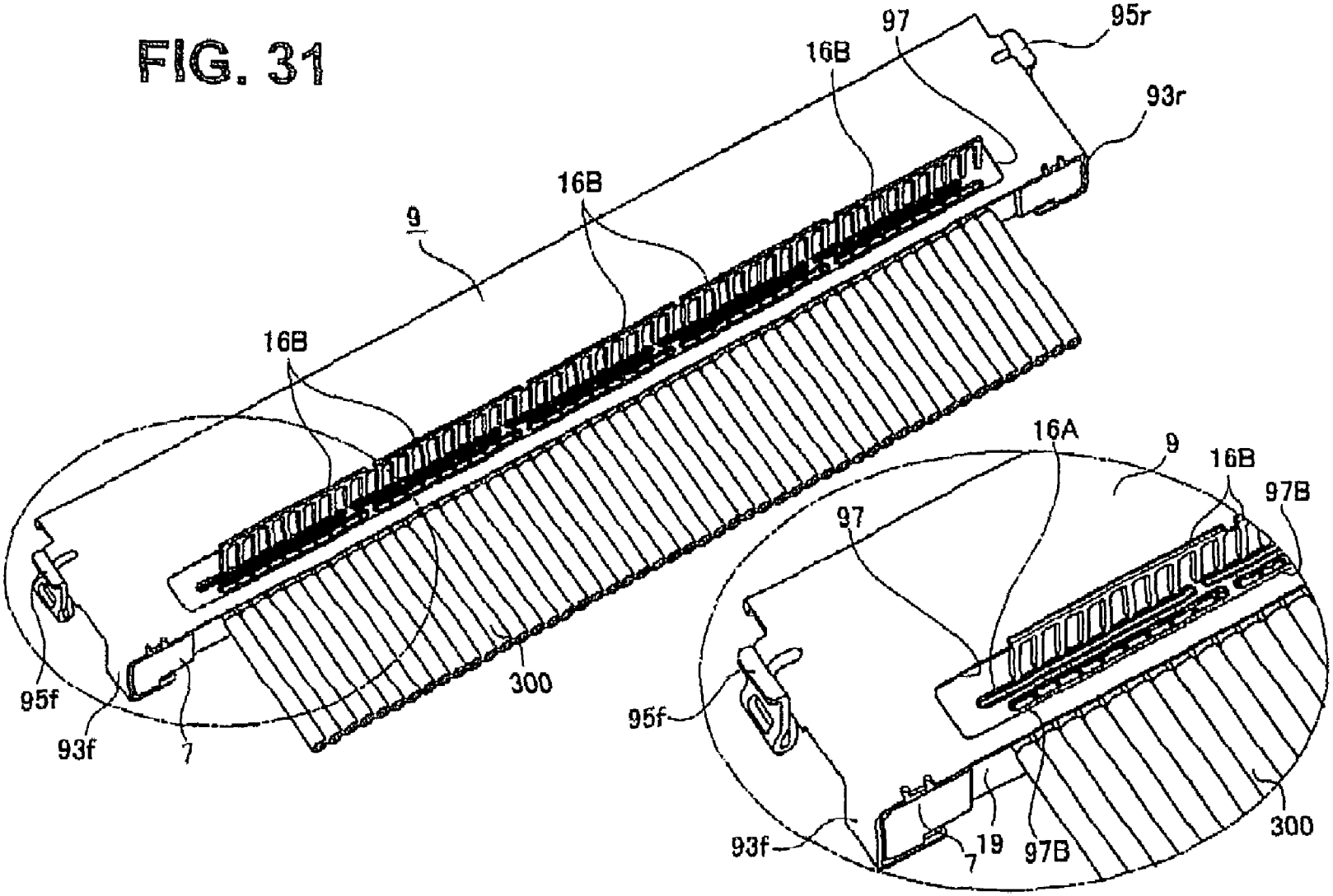
FIG. 31 is a perspective view showing a state immediately prior to mounting to the housing of FIG. 30 a cable holder for holding an even-numbered coaxial cable as counted from the left side of the drawing, and an enlarged view of a selected portion thereof.
Figure 32:
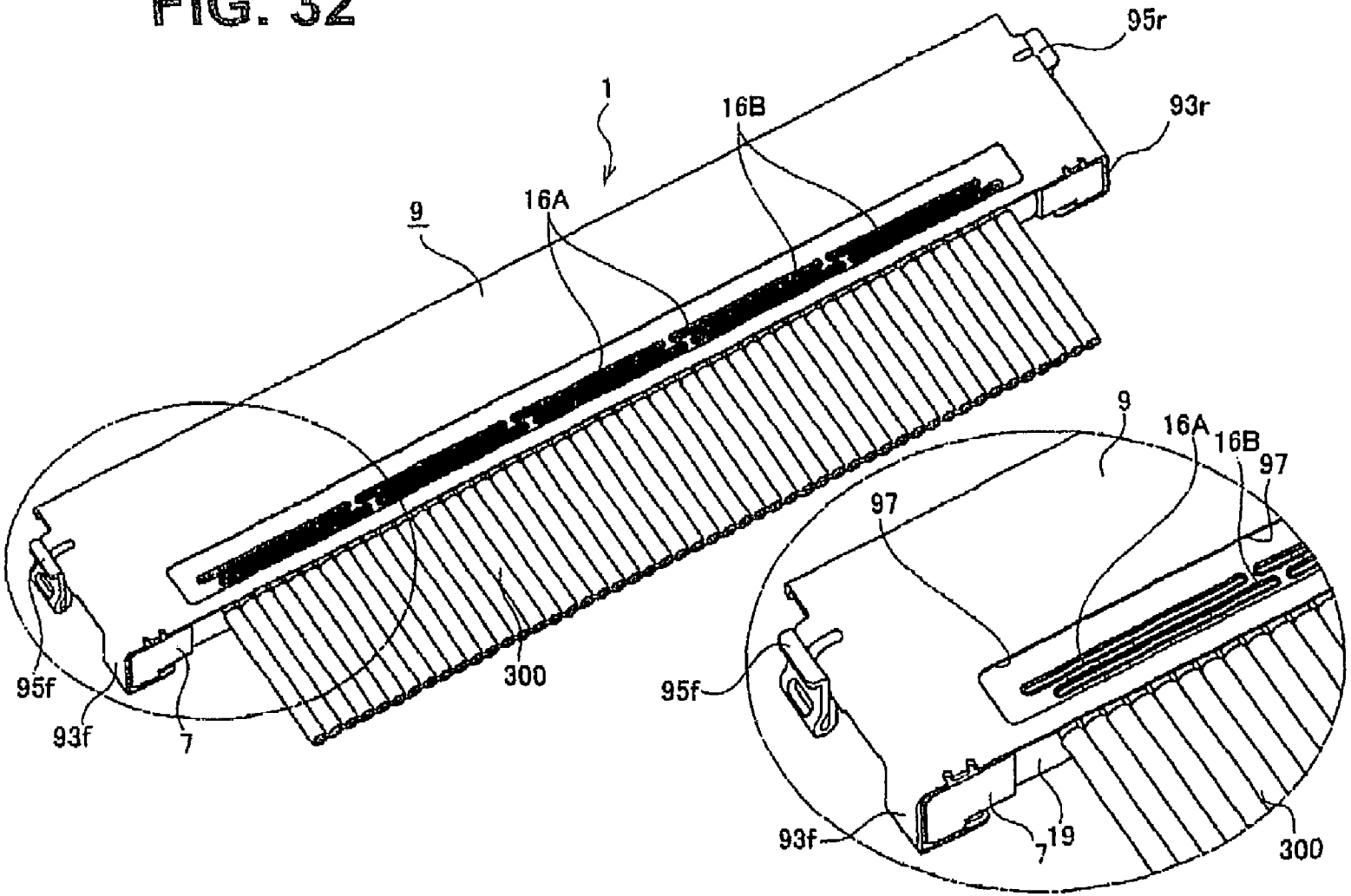
FIG. 32 is a perspective view showing a state immediately after mounting the cable holder of FIG. 31 to the housing, and an enlarged view of a selected portion thereof.

By a further procedure, step (4), the housing 7 with coaxial cables 300 soldered to the terminals 17 is covered with the shell 9, which typically is a metal cover or otherwise strong and durable cover. This is illustrated in FIGS. 27 & 28.

Thereafter, according to step (5), the cable holder 16A is inserted into the through-hole 97A, the through-hole 191A, and the cable holder fitting hole 111A. FIGS. 5, 7, 8, 29, 30, 33 and 34 illustrate same.

Step (6) inserts the cable holder 16B into the through-hole 97B, the through-hole 191B, and the cable holder fitting hole 111B. FIGS. 7, 9, 31 and 32 illustrate this procedure.

The mating connector 2 now is described with reference to FIGS. 1, 2, 5, and 6. The mating connector 2 has a mating housing 21 formed of synthetic resin or other insulating resin, mating terminals 27 fitted on the mating housing 21 and brought into contact with the terminals 17 of the connector 1 upon fitting engagement between the connector 1 and the mating connector 2 (FIG. 5) and a mating shell 29 covering the mating housing 21.

The shape of the mating housing 21 is that of an elongated rectangle in plan view, which also is the shape of the housing 7. Further, the mating housing 21 has mating terminal insertion portions 23 into which the mating terminals 27 are inserted and which are provided parallel to one another in the longitudinal direction (left-to-right direction) in the same number as that of the mating terminals 27 (see FIGS. 1 & 5). Further, as can be seen in FIG. 1, formed on either side of the rear edge portion of the mating housing 21 is a locking protrusion 211 for mounting the mating shell 29.

Preferably the mating terminal 27 is formed by machining a thin metal plate. As can be seen from FIGS. 5 & 6, the mating terminal 27 has a main portion 271 having a substantially horizontal E-shaped configuration and an extending portion 273 having a substantially horizontal L-shaped configuration, with the main portion 271 and the extending portion 273 being connected in series in the front-to-rear direction. Further, the main portion 271 is provided with a press-fitting member 271*a* so that the mating terminal 27 is attached to the mating housing 21 by press-fitting the main portion 271 of the mating terminal 27 into the mating terminal insertion portion 23 of the mating housing 21 for fixation. A press-fitting hole 23*a* is provided in the mating terminal insertion portion 23 in an opposing relation to the press-fitting member 271*a* (FIGS. 5 & 6).

In the extending portion 273, the terminal 17 is fitted inside a space S defined by the extending portion 273 upon connecting the connector 1 and the mating connector 2 together (FIGS. 5 & 6). Further, the distal end of the extending portion 273 is formed as a protruding distal end portion 273*a* bent toward the terminal 17 side. Electrical connection is established between the connector 1 and the mating connector 2 as the distal end portion 273*a* comes into contact with the rear upright leg 171*r* of the terminal 17 of the connector 1.

The mating shell 29 serves to mount the connector 1 and the mating connector 2 to each other as the mating shell 29 is coupled with the shell 9 of the connector 1. The mating shell 29 covers the front edge and opposite side portions of the mating housing 21. A regulation plate 291, which serves to guide the connector 1 or prevent push-back of the connector 1 as it is brought into mating engagement with the mating connector 2, is provided upright in the front edge portion of the mating connector 2. Provided on opposite sides of the regulation plate 291 are cover portions 293*f*, 293*r* covering the opposite side portions of the mating housing 21 (FIGS. 1 & 2)

The cover portions 293*f*, 293*r* are provided with engaging holes 295*f*, 295*r* engaging with the locking members 95*f*, 95*r* of the shell 9, respectively (FIGS. 1 & 2). The size of the engaging holes 295*f*, 295*r* in the width direction (left-to-right direction) is somewhat larger than the thickness dimension of the locking members 95*f*, 95*r* of the shell 9 in the state when the locking members 95*f*, 95*r* are not applied with an external force and hence their opening is not closed. Further, the distance between the engaging holes 295*f*, 295*r* is set to be slightly smaller than the distance between the locking members 95*f*, 95*r*.

Further, formed in the rearward surface of each of the cover portions 293*f*, 293*r* is an engaging hole 297 to be engaged with the locking protrusion 211 of the mating housing 21. To mount to each other the connector 1 and the mating connector 2, constructed as described above, the connector 1 is attached from above the mating connector 2 (FIGS. 1, 2, 5 & 6).

At this time, the connector 1 and the mating connector 2 are aligned in their orientations such that the locking members 95*f*, 95*r* of the connector 1 enter the engaging holes 295*f*, 295*r*, respectively, of the mating connector 2. Since the engaging holes 295*f*, 295*r* are larger in their width direction (left-to-right direction) than the thickness dimension of the locking members 95*f*, 95*r* of the shell 9 at the time when no external force acts on the locking members 95*f*, 95*r*, the locking members 95*f*, 95*r* are easily pushed into the engaging holes 295*f*, 295*r*, respectively. Because the distance between the engaging holes 295*f*, 295*r* is set to be slightly smaller than the distance between the locking members 95*f*, 95*r*, upon mounting the connector 1 and the mating connector 2 to each other, the locking members 95*f*, 95*r* of the connector 1 are each applied with an external force from the mating connector 2 which acts to close its opening. As a result, a resilient force develops in the locking members 95*f*, 95*r*, which serves to prevent dislodging of the locking members 95*f*, 95*r* from the engaging holes 295*f*, 295*r*, respectively. Accordingly, the connector 1 and the mating connector 2 are combined together with firm connection being established between the connector 1 and the mating connector 2.

The operation and effects of the connector constructed as described above now are described. Because the depression 174*a* is formed in the terminal 17 of the connector 1, the fused solder H is received within the depression 174*a*. Accordingly, the majority of the fused solder H forms the fillet Fh within the depression 174*a* without spreading past the periphery of the depression 174*a* (FIGS. 18-23). The solder has more surface area to adhere to in the depression as compared to a flat termination surface and this increases the strength of the solder joint between the terminal and the wire. Thus, as compared with the case of conventional terminals with no such depression 174*a* provided in the soldering region 174 (FIG. 35*b*), there is relatively little or no spreading of the solder H over the surface of the terminal 17 (see FIG. 35(*a*)). Due to the formation of the fillet Fh in the depression 174*a*, the connection between the terminal 17 and the fillet Fh becomes a three-dimensional one, causing an increase in connection surface area and/or volume, whereby the terminal 17*a* takes on a configuration as if a root has grown between the conductor 302 and the terminal 17 (FIG. 23).

Further, as seen in cross-section in FIG. 23, the depression 174*a* has an arcuate bottom surface, whereby the bottom surface contacts the fused solder over a large contact area, larger for example when compared with a terminal without such a depression. This makes it possible to achieve an enhanced connection force between the terminal 17 and the inner conductor 302.

Figure 35:
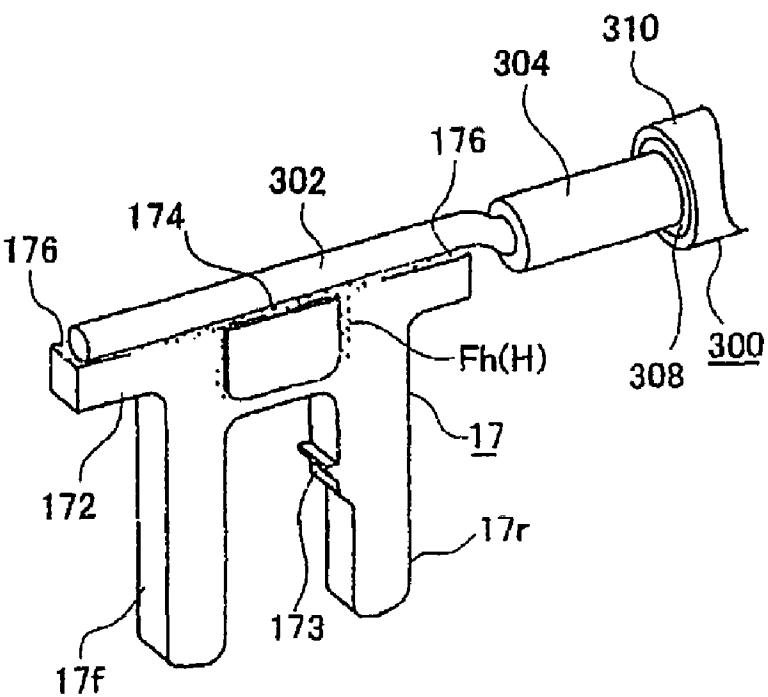
FIG. 35 is a diagram showing the terminal according to the present invention as compared with a conventional terminal having no depression and stepped portion, in which part (a) shows the terminal according to the present invention, and part (b) shows the conventional terminal.
Figure 35:
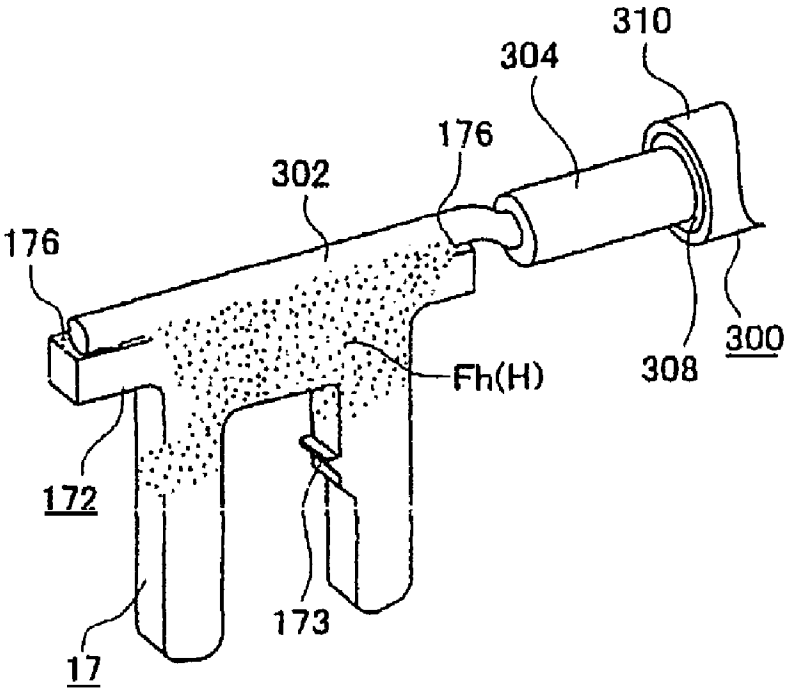

Further, the sidewall stepped portion 179, when provided, is an island-like region formed in the connector 1 that further accommodates excess solder should such be needed to prevent unwanted solder migration with this arrangement, even when a somewhat large amount of fused solder H is present, as shown in FIG. 35*a*, the fused solder H spreads toward and around the periphery of the stepped portion 179, whereby, as compared with the case where no stepped portion 179 is formed as shown in FIG. 35(*b*), the fused solder H is prevented from unnecessarily spreading toward the other side surface region 175. As a result, solder is prevented from flowing into the portions of the rear upright leg 171*r* which comes into contact with the distal end portion 273*a* of the mating terminal 27.

It will be appreciated that the fillet Fh provides excellent strength to the connection between the inner conductor 302 and the coaxial cable 300. As a result of the controlled shaping of the fillet during its formation, the strength of the force with which the inner conductor 302 of the coaxial cable 300 is connected to the terminal 17 through the fillet Fh can be retained even when the width dimension of the fillet Fh is reduced. Therefore, the width dimension of the terminal 17 can be reduced while maintaining the connection force between the terminal 17 and the inner conductor 302 without having to modify the conduct or 302.

Further, in the connector 1, the fitting holes 111A, 111B into which the cable holders 16A, 16B are respectively fitted are provided in the housing 7, and the through-holes 97A, 97B respectively opposed to the fitting holes 111A, 111B are provided in the shell 9. When the cable holders 16A, 16B are fitted into the fitting holes 111A, 111B via the through-holes 97A, 97B, respectively, the cable holders 16A, 16B are received within the housing 7 in a state of straddling and nipping the coaxial cables 300, whereby no soldering is required to hold the coaxial cables 300 onto the housing 7.

When the cable holders 16A, 16B are fitted into the cable holder fitting holes 111A, 111B via the through-holes 97A, 97B, respectively, the substrate portion 16*a* is located within the through-holes 97A, 97B (FIGS. 5, 6, 8 & 9). Comparing this structure with that of the case where the cable holders 16A, 16B are fitted into the cable holder fitting holes 111A, 111B of the housing 7 and then the housing 7 is covered with a shell having no through-holes 97A, 97B, respectively, provided that the length of the legs 16*b* of the cable holders 16A, 16B, and provided that the insertion amount of the legs 16*b* into the cable holder fitting holes 111A, 111B are the same between the two structures, the cable holders 16A, 16B of the connector 1 have their respective substrate portions 16*a* exposed and located within the through-holes 97A, 97B of the shell 9, whereby the height dimension of the connector 1 can be reduced correspondingly.

Figure 36:
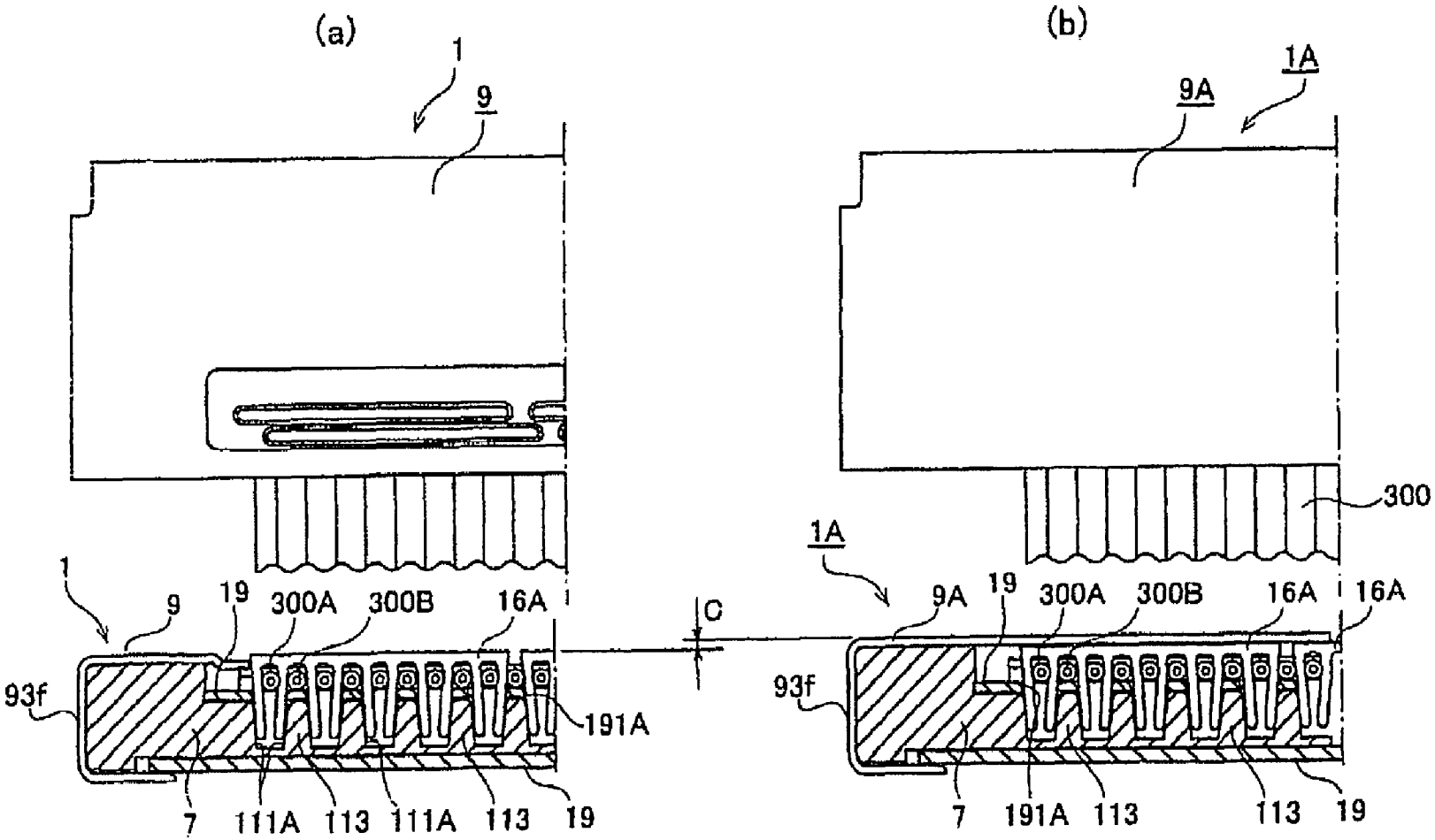
FIG. 36 is a diagram for explaining the effect of forming a through-hole in the shell of the connector according to the present invention as compared with the case where no such through-hole is provided, in which part (a) shows the shell according to the present invention, and part (b) shows a shell with no through-hole.
Figure 37:
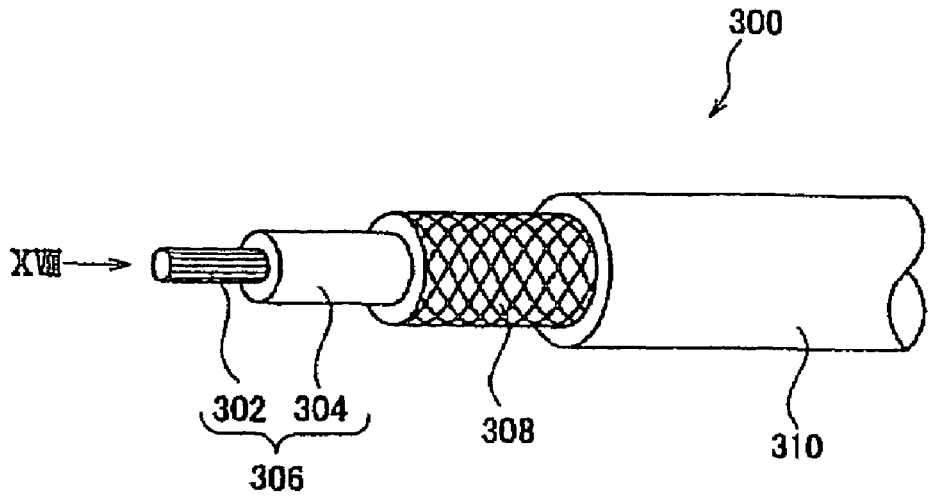
PRIOR ART FIG. 37
FIG. 37 is a perspective view of a coaxial cable.
Figure 38:
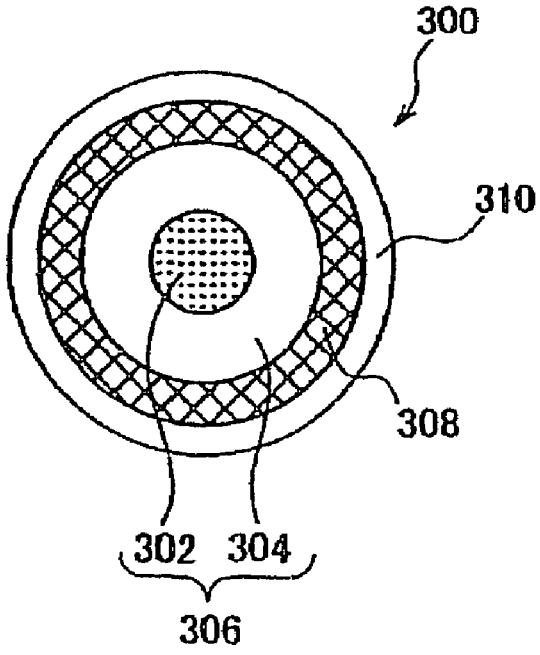
FIG. 38 PRIOR ART
FIG. 38 is an enlarged transverse cross-sectional view of the coaxial cable shown in FIG. 37.
Figure 39:
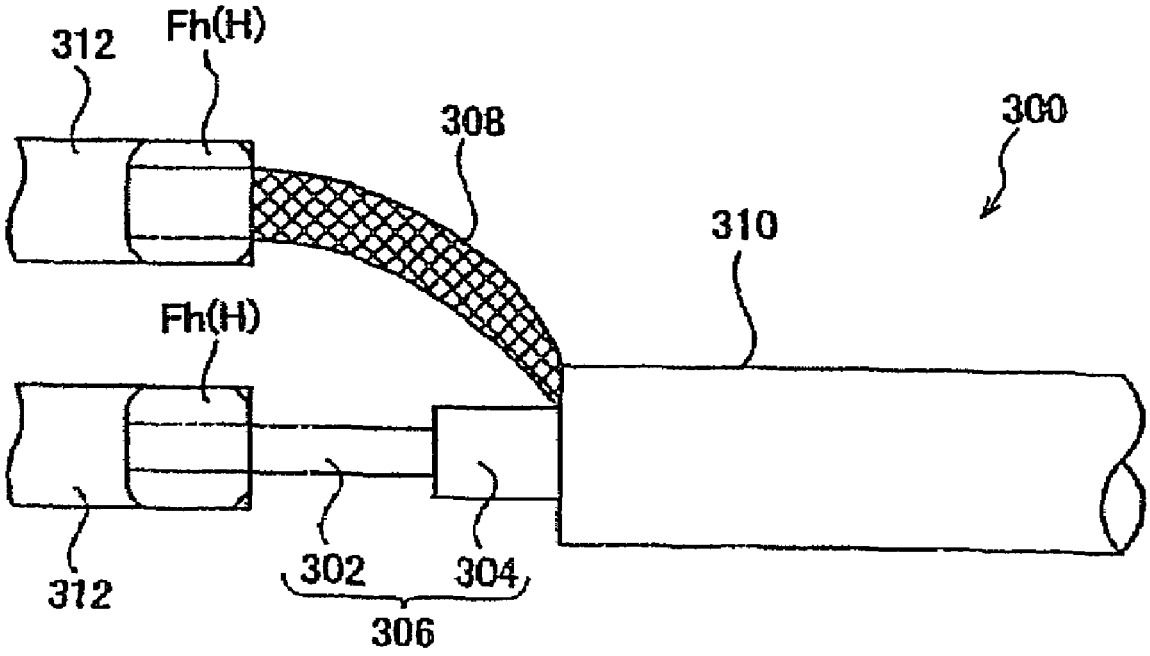
PRIOR ART FIG. 39
FIG. 39 is a diagram illustrating a state in which the coaxial cable of FIG. 37 is soldered onto a terminal.

FIG. 36 illustrates an actual comparative example, wherein FIG. 36*a* shows the shell 9 according to this embodiment, and FIG. 36*b* shows a connector 1A to which a shell 9A having no through-holes is applied. It can be appreciated from the drawings that the height dimension is reduced by a dimension C, that is by an amount corresponding to the substrate portion 16*a* of the cable holder 16A, 16B which is exposed and located within the through-hole 97A, 97B of the shell 9. It is to be noted that the same reference numerals are used to denote the same or like components in FIGS. 36*a* and 36*b*.

Further, with the connector 1, the coaxial cables 300 are held onto the housing 7 by using the cable holders 16A, 16B, and soldering is not performed to hold the coaxial cables 300 onto the housing 7. This feature prevents hardening of electric wires due to solder wicking.

Furthermore, as counted from one end (the left side in FIG. 4) of the large number of coaxial cables 300 arranged in parallel into a flat configuration, the odd-numbered coaxial cables 300A and the even-numbered coaxial cables 300B are held by different cable holders, namely the odd-numbered cable holders 16A and the even-numbered cable holders 16B, respectively. The cable holders 16A, 16B each can be arranged parallel in the front-to-rear direction but offset in the left-to-right direction with respect to one another, whereby the odd-numbered cable holders 16A reliably hold solely the odd-numbered coaxial cables 300A and the even-numbered cable holders 16B reliably hold solely the even-numbered coaxial cables 300B. Accordingly, it is possible to ensure that there is no single coaxial cable 300 that is insufficiently retained.

Further, the width W2 of the cable holder fitting holes 111A, 111B is substantially the same as the width W1 between adjacent legs 16*b*, and the cable holder fitting holes 111A, 111B are hole portions each shaped like an inverted truncated isosceles triangle and tapered such that its width is large at the top and small at the bottom. Therefore, as the respective legs 16*b* of the cable holders 16A, 16B are inserted into the cable holder fitting holes 111A, 111B of the housing 7, the deeper the cable holders 16A, 16B are inserted into the cable holder fitting holes 111A, 111B, respectively, the narrower is the gap between the two legs of the respective double-legged portions of the cable holders 16A, 16B, leading to a corresponding increase in the force for holding the coaxial cable 300 sandwiched between the two legs of the double-legged portion.

The connection reliability for the coaxial cables 300 is thus enhanced. Accordingly, every single one of the coaxial cables 300 can be reliably nipped solely by inserting the cable holders 16A, 16B into the cable holder fitting holes 111A, 111B, respectively. Furthermore, mechanical connection is effected on the coaxial cables 300 such that each coaxial cable 300 is sandwiched from above and below by the substrate portion 16*a* of each of the cable holders 16A, 16B and the ground bar 19, respectively, and such that the pair of legs 16*b*, 16*b* constituting the double-legged portion sandwich the coaxial cable 300 from the left and right sides. Further, as described above, upon inserting the cable holders 16A, 16B into the cable holder fitting holes 111A, 111B, respectively, the outer conductor 308 of the coaxial cable 300 is sandwiched from below and above by the ground bar 19, which is in contact with the shell 9 through both of its side arms 93*f*, 93*r* and the cable holders 16A, 16B, respectively, for electrical connection (FIGS. 5, 6, 8, 33 & 34). Therefore, the cable holders 16A, 16B can effect both electrical and mechanical connections of the coaxial cable 300 at the same time, thereby achieving an improvement in operability.

In addition, while the coaxial cable connector exemplified in this embodiment is the coaxial cable (braided coaxial cable) including the outer conductor covering the signal line 306 and consisting of the large number of spirally wound or braided electric wires, as long as it is used solely for soldering the terminal 17, a coaxial cable of a so-called semi-rigid structure whose outer conductor is made of a copper pipe, or a so-called discrete cable other than the coaxial cable, also may be used.

It will be understood that the embodiments of the present invention which have been described are illustrative of some of the applications of the principles of the present invention. Numerous modifications may be made by those skilled in the art without departing from the true spirit and scope of the invention. Various features which are described herein can be used in any combination and are not limited to procure combinations that are specifically outlined herein.

The invention claimed is:

1. A terminal for a fine-pitch electrical connector, comprising:

a body portion having a termination surface and a side surface region;

at least two contact portions extending from the terminal body portion and projecting away from said termination surface of said terminal body portion;

a depression disposed on said terminal body portion at a location generally between said contact portions, said depression being positioned on the termination surface for receiving molten solder to form a solder fillet to secure a conductor to the termination surface;

a solder-directing path disposed on the side surface of said terminal body portion, the solder-directing path including an outwardly stepped portion and being positioned proximate to said depression to accept excess molten solder from said depression during formation of the fillet.

2. The terminal in accordance with claim 1, wherein said outwardly stepped portion of the solder directing path is defined by a step.

3. The terminal in accordance with claim 1, wherein said contact portion extends at an angle to the termination surface.

4. The terminal in accordance with claim 2, wherein said termination surface has a first width and said termination surface further includes a soldering region of said terminal, the soldering region having a second width which is greater than that of the first width to thereby define the stepped portion, said step being formed at a boundary portion between the stepped portion and said termination surface, said step including said solder-directing path, said depression being disposed within said second width.

5. The terminal in accordance with claim 1, wherein said at least two contact portions are a pair of two spaced-apart legs, said terminal body portion including a connecting portion between said legs, and said solder-directing path is disposed on said connecting portion.

6. The terminal in accordance with claim 5, further including two of said connecting portions, each on opposite-facing sides of said terminal body portion.

7. The terminal in accordance with claim 4, wherein said stepped portion is an island-like region protruding from said surface of said terminal body portion, said stepped portion being continuous with said soldering region.

8. The terminal in accordance with claim 1, wherein said depression is elongated in a longitudinal direction along said termination surface.

9. The terminal in accordance with claim 1, wherein said depression has an arcuate bottom surface.

10. A fine-pitch connector for connecting wires to a circuit board, comprising:

an insulative housing having a body portion with two opposing ends;

a plug portion extending from the housing body portion;

a plurality of conductive terminals arranged in fine-pitch spaced-apart order between said opposing ends of the housing;

said terminals each including a body portion supported along said housing body portion, the body portion having a termination surface and a side surface region;

said terminals each including at least two contact portions extending from said terminal body portion and disposed on said housing plug portion, each contact portion having a contact surface exposed on said housing plug portion;

a depression disposed in said terminal body portion at a location on the termination surface generally between said contact portions, said depression being positioned on said termination surface for receiving molten solder to form a solder fillet to secure a wire to the termination surface;

a solder-directing path disposed on the side surface of said terminal body portion, said solder-directing path including an outwardly stepped portion and being positioned proximate to said depression to accept molten solder from the depression during formation of the fillet.

11. The connector in accordance with claim 10, wherein said solder-directing path accommodates molten solder in excess of that required to form the fillet and prevents molten solder flow between said terminals.

12. The connector in accordance with claim 10, wherein said outwardly stepped portion of the solder directing path is defined by a step.

13. The connector in accordance with claim 10, wherein said contact portion extends at an angle to the body portion.

14. The connector in accordance with claim 10, wherein said depression is within a soldering region of the terminal, said soldering region having a width greater than that of the termination surface of the terminal in order to thereby define the stepped portion, said step being formed at a boundary portion between the stepped portion and said termination surface, said step including said solder directing path.

15. The connector in accordance with claim 10, wherein said at least two contact portions comprise two upright legs, said body having a connecting portion between said legs, and said solder-directing path is at said connecting portion.

16. The connector in accordance with claim 14, wherein said stepped portion is an island-like region protruding from said body, said stepped portion being continuous with said soldering region.

17. The connector in accordance with claim 10, wherein said depression has an arcuate bottom surface.

* * * * *